US010907447B2

(12) United States Patent
Stang et al.

(10) Patent No.: US 10,907,447 B2
(45) Date of Patent: Feb. 2, 2021

(54) MULTI-CYCLE WELLBORE CLEAN-OUT TOOL

(71) Applicant: Stang Technologies Limited, Macklin (CA)

(72) Inventors: Jonathan M Stang, Macklin (CA); Daryl E Magner, Arvada, CO (US)

(73) Assignee: Stang Technologies Limited, Macklin (CA)

( * ) Notice: Subject to any disclaimer, the term of this patent is extended or adjusted under 35 U.S.C. 154(b) by 165 days.

(21) Appl. No.: 16/280,364

(22) Filed: Feb. 20, 2019

(65) Prior Publication Data

US 2019/0360308 A1 Nov. 28, 2019

Related U.S. Application Data

(60) Provisional application No. 62/778,384, filed on Dec. 12, 2018, provisional application No. 62/677,023, filed on May 27, 2018.

(51) Int. Cl.

| | |
|---|---|
| ***E21B 37/00*** | (2006.01) |
| ***E21B 34/10*** | (2006.01) |
| ***E21B 23/00*** | (2006.01) |
| ***E21B 4/02*** | (2006.01) |
| *E21B 21/00* | (2006.01) |
| *E21B 29/00* | (2006.01) |

(52) U.S. Cl.

CPC ..... *E21B 37/00* (2013.01); *E21B 4/02* (2013.01); *E21B 23/006* (2013.01); *E21B 34/10* (2013.01); *E21B 21/00* (2013.01); *E21B 29/002* (2013.01); *E21B 2200/06* (2020.05)

(58) Field of Classification Search

CPC ..... E21B 21/00; E21B 23/006; E21B 29/002; E21B 34/10; E21B 37/00; E21B 37/08; E21B 41/0078; E21B 4/02; E21B 2034/007; E21B 2200/06

See application file for complete search history.

(56) References Cited

U.S. PATENT DOCUMENTS

| | | | |
|---|---|---|---|
| 2,034,768 | A | 3/1936 | O'Neill |
| 4,804,044 | A | 2/1989 | Wesson et al. |
| 5,335,731 | A | 8/1994 | Ringgenberg et al. |
| 5,529,126 | A | 6/1996 | Edwards |
| 5,890,542 | A | 4/1999 | Ringgenberg |
| 5,984,014 | A | 11/1999 | Poullard et al. |
| 6,109,354 | A | 8/2000 | Ringgenberg et al. |

(Continued)

*Primary Examiner* — Daniel P Stephenson

(74) *Attorney, Agent, or Firm* — Peter L. Brewer; Thrive IP

(57) ABSTRACT

A clean-out tool and method of cleaning out a wellbore. The clean-out tool is placed at the end of a coiled tubing or other conveyance string. The clean-out tool comprises a tubular housing providing an elongated bore through which fluid flows. The tubular housing has back-jetting ports disposed at an upward angle therein. The clean-out tool is configured to operate in a back-jetting mode when the clean-out fluid is pumped into the tubular housing at a first flow rate. In this mode, a portion of clean-out fluid flows through the bore, up an annular region and then through the back jetting ports. The clean-out tool is further configured to operate in a fluid flow-through mode when the clean-out fluids are pumped into the bore of the tubular housing at a second flow rate. In this mode, all of the clean-out fluid flows through the clean-out tool.

45 Claims, 21 Drawing Sheets

(56) References Cited

U.S. PATENT DOCUMENTS 6,289,999 B1 * 9/2001 Dewey ..... E21B 23/006 175/38
6,659,186 B2 12/2003 Patel
6,668,948 B2 * 12/2003 Buckman, Sr. ..... B05B 1/3447 175/393
6,874,579 B2 4/2005 Johnson et al.
6,889,771 B1 5/2005 Leising et al.
7,090,020 B2 8/2006 Hill et al.
7,168,491 B2 1/2007 Malone et al.
7,213,648 B2 5/2007 Hayes et al.
7,568,525 B2 8/2009 Veselkov
7,644,774 B2 1/2010 Branch et al.
7,814,978 B2 10/2010 Steele et al.
8,276,677 B2 10/2012 Ravensbergen
8,312,925 B2 11/2012 Trummer et al.
8,490,702 B2 7/2013 Stromquist et al.
8,931,557 B2 * 1/2015 Patterson ..... E21B 34/14 166/308.1
8,967,300 B2 * 3/2015 Dewey ..... E21B 10/322 175/269
8,978,784 B2 3/2015 Miszewski
8,985,227 B2 * 3/2015 Nikiforuk ..... E21B 33/16 166/386
9,115,558 B2 8/2015 Stang
9,494,014 B1 11/2016 Manke et al.
2002/0062963 A1 5/2002 Eslinger et al.
2004/0129423 A1 7/2004 Eddison
2007/0284106 A1 12/2007 Kalman et al.
2009/0250224 A1 10/2009 Wright et al.
2012/0205108 A1 8/2012 Stang
2013/0031615 A1 * 1/2013 Woodward ..... H04W 8/02 726/4
2014/0069648 A1 3/2014 Dotson et al.
2014/0158357 A1 6/2014 Lyashkov et al.
2014/0182699 A1 * 7/2014 Manson ..... E21B 21/00 137/15.05
2014/0262263 A1 9/2014 Yudin et al.
2014/0262321 A1 * 9/2014 Fripp ..... E21B 43/12 166/373
2015/0159468 A1 * 6/2015 Mailand ..... E21B 34/14 166/297
2015/0275641 A1 10/2015 Watson et al.
2016/0053592 A1 2/2016 Getzlaf et al.
2016/0326834 A1 * 11/2016 Manke ..... E21B 21/103
2017/0260838 A1 9/2017 Livescu et al.
2018/0252078 A1 9/2018 Schultz
2019/0360308 A1 * 11/2019 Stang ..... E21B 4/02
2020/0087999 A1 * 3/2020 Stang ..... E21B 37/00
2020/0115997 A1 * 4/2020 Stang ..... E21B 1/00

* cited by examiner

MULTI-CYCLE WELLBORE CLEAN-OUT TOOL

CROSS REFERENCE TO RELATED APPLICATIONS

This application claims the benefit of U.S. Ser. No. 62/677,023 filed May 27, 2018. That application is entitled "Multi-Cycle Wellbore Clean-Out Tool."

This application also claims the benefit of U.S. Ser. No. 62/778,384 filed Dec. 12, 2018. That application is also entitled "Multi-Cycle Wellbore Clean-Out Tool." These two provisional patent applications are incorporated herein by reference in their entireties.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of hydrocarbon recovery operations. More specifically, the invention relates to wellbore completions and remediation operations. Further still, the invention relates to a tool that may be connected to a string of coiled tubing (or other working string) and used for wellbore clean-out.

Technology in the Field of the Invention

During the course of a wellbore operation, it is sometimes desirable to clean out the wellbore. For example, after a well is completed and before a string of production tubing is hung, the operator may wish to run a clean-out tool down the hole to circulate out cement chips, sand, and other debris. For this operation, a clean-out tool is used.

In addition, it is sometimes desirable to clean out a producing well that has become filled with sand. Such incidents may occur because the well is producing from an unconsolidated formation, or due to a poorly designed fracturing operation.

In either of these instances, a simple nozzle may be run into a wellbore at the end of a coiled tubing string. A coiled tubing connector may be used to connect the coiled tubing string with the nozzle. An aqueous circulating fluid is pumped down the working string, through the nozzle and then up the back side (or annulus) of the working string. Preferably, a surfactant, an acid or other chemical is injected down the coiled tubing string as part of the clean-out.

A separate type of tool that also involves circulating fluid down a working string is an abrasive perforating tool.

Abrasive perforating tools utilize lateral jetting ports that allow a fluid containing abrasive particles, e.g., sand, to be pumped downhole through the working string at high pressures and then out of the jetting ports laterally. The abrasive fluid erodes through the surrounding casing at a designated depth, then through the cement, and out into the surrounding rock formation. This is an alternative to explosive charge perforating.

Some abrasive perforating tools frequently offer a clean-out function using reverse circulation. In one aspect, an abrasive perforating tool may be part of a bottom hole assembly containing a reverse ball check valve. The BHA components include a so-called CT connector, a disconnect, a stabilizer, an abrasive cutting sub having at least one jetting nozzle, the reverse ball check valve, and then the nozzle. A schematic view of such a device is shown in FIG. 1 of U.S. Pat. No. 9,115,558, the entirety of which is incorporated herein by reference.

The reverse ball check valve of the '558 patent includes a pin and a ball. When fluid is pumped down the coiled tubing, the reverse ball check valve is forced closed, preventing fluid from exiting the nozzle at the bottom of the BHA. Fluid is then directed through the lateral jetting ports for hydraulic perforating. Subsequently, when sand or other particulates are required to be cleaned out, a "reverse clean-out" procedure is conducted.

To perform the reverse clean-out, an aqueous fluid is injected down the back side of the coiled tubing. The fluid is pumped downhole where it then flows back up the BHA, through the reverse ball check valve, through the bore of the coiled tubing string and back up to the surface. The fluid returns will include the abrasive fluid used in the perforating process. A somewhat schematic reverse clean-out flow for a BHA having a known reverse ball check valve is shown in FIG. 2 of the '558 patent.

As described in greater detail in the '558 patent, the use of reverse flow clean-out valves is often impractical in connection with horizontal wellbores. This is because of the significant likelihood of fill material gathering around the outer diameter of the BHA during the reverse circulation phase. In this respect, the BHA cannot take advantage of gravity to bring the fill material down to the nozzle as is present in a vertical well. Depending on the size of the wellbore, the length of the horizontal leg of the well and the cleanout medium used, the annular velocity (governed by gauge pressure at the surface) likely will not be high enough to sweep the entire fill to the end of the bottom hole assembly.

Due to this limitation, the '558 patent disclosed a novel abrasive perforating tool capable of being cycled during pumping operations to provide clean-out. Beneficially, fluids can be pumped down the bore of the working string in the same direction for both abrasive perforating and for clean-out, using a cycling mechanism. This allows for a multi-cycle adjustment of tool function carried out by manipulating pumping rates.

A need exists for a downhole tool that operates with a similar cycling mechanism for wellbore clean-out but without the abrasive perforating function. A need further exists for a downhole flow diverter tool that not only provides for wellbore clean-out, but which permits the operation of a separate hydraulically actuated tool further down the tool string, such as a positive displacement motor.

BRIEF SUMMARY OF THE INVENTION

A multi-cycle clean-out tool for controlling a direction of a clean-out fluid within a wellbore is first provided herein.

The wellbore is lined with a string of production casing. Optionally, the wellbore further includes a string of production tubing. In this case, the multi-cycle clean-out tool is dimensioned to be run into the production tubing.

The clean-out tool first includes a tubular housing. The tubular housing provides an elongated bore through which clean-out fluid may flow. The tubular housing includes one or more back jetting ports disposed at an upward angle therein. The upward angle is preferably at 15° to 60°, and more preferably at 45° relative to the longitudinal central axis of the tool.

The clean-out tool also includes a piston. The piston defines a short cylindrical body that is disposed at an upstream end of the housing. The piston has at least one orifice configured to deliver fluids from a wellbore conveyance tubing to the elongated bore of the housing. Of interest, the piston forms a pressure shoulder as fluids are injected through the conveyance tubing.

The clean-out tool additionally includes a tubular mandrel. The tubular mandrel is slidably positioned within the housing. The mandrel has a proximal end connected to or otherwise acted upon by the piston, and an open distal end, wherein the distal end forms a plunger. In one embodiment, the plunger is a separate body threadedly connected to the distal end of the mandrel.

The clean-out tool further includes a seat. The seat is disposed along the tubular housing below the distal end of the tubular mandrel. The seat is dimensioned to receive the plunger when the piston and connected tubular mandrel slide from a raised position to a lowered position along the tubular housing. The seat provides a means for sealingly receiving the plunger.

In one embodiment, the seat operates with or includes a stem. The stem defines a cylindrical body that extends up from the seat. The cylindrical body includes an elongated bore, and may be connected to the seat to form an integral seat piece.

The cylindrical body is dimensioned to closely receive the plunger. More specifically, an outer diameter of the stem telescopically receives the plunger. Of interest, the stem and the plunger remain engaged in overlapping relation during the entire fluid circulation operation, with the degree of overlap changing as the piston, the mandrel and the connected plunger move between raised and lowered positions. In this arrangement, the stem contains the central orifice for fluid flow through the seat.

In one optional arrangement, a central orifice of the seat provides a restricted opening, creating a pressure drop during use. Alternatively, where a stem is used the orifice restriction is contained within the stem. The restricted opening creates a fluid restriction in one setting, and a pressure indicator in another. In one arrangement, a separate nozzle is disposed below the tubular housing for wellbore cleanout. In still another embodiment, a positive displacement motor is disposed below the tubular housing.

Where a stem is used above the seat, the stem will contain one or more through-openings. When the plunger is in its raised position, a portion of the clean-out fluid will flow through the radially-disposed flow slots and up the back side of the mandrel. This permits the clean-out fluid to flow through the back-jetting ports.

A lower annular region is formed between the mandrel and the surrounding tubular housing. The lower annular region provides fluid communication between the elongated bore of the tubular housing and the back jetting ports when the plunger is above the seat. However, when the plunger is moved to its lowered position the plunger will pass across the through-openings, substantially precluding clean-out fluid from flowing back up the lower annular region. In this case, when the plunger is in contact with the seat all clean-out fluid will pass through the orifice of the seat.

The tubular housing may comprise an upper sub having a first upper end and a second lower end. The upper end may serve as a box end that threadedly connects to a CT connector or a bottom hole assembly. The tubular housing may further comprise a lower sub also having a first upper end and a lower end. The first end of the lower sub is abutted to a lower end of the seat, while the lower end may be threadedly connected to a downhole cleaning tool such as a nozzle or a positive displacement motor.

In a preferred embodiment, the wellbore clean-out tool includes a spring. The spring resides in an upper annular region between the tubular mandrel and the surrounding tubular housing above the lower annular region. The spring is pre-loaded in compression to bias the mandrel and connected plunger in the raised position. The upper annular region (with the spring) and the lower annular region (with the back-jetting ports) are sealingly separated.

The clean-out tool is configured to cycle a position of the mandrel and connected plunger in response to fluid pumping rate into the wellbore. In this way, a flow of clean-out fluid through the back jetting ports may be adjusted. Preferably, the clean-out tool is configured to cycle between two operating modes—a back-jetting mode and a flow-through mode. In the back-jetting mode, clean-out fluid is pumped into the bore of the tubular housing at a first flow rate. In this mode, a portion of the clean-out fluid flows through the mandrel, back up the lower annular region, and then through the back-jetting ports. This leaves the remaining portion of the clean-out fluid to flow through the seat and out of the clean-out tool.

The clean-out tool is also configured to cycle to a flow-through mode. This occurs when the clean-out fluid is pumped into the bore of the tubular housing again at a second higher flow rate. In this mode, all (or certainly substantially all) of the clean-out fluid flows through the mandrel, through the seat, and out of the bottom of the clean-out tool.

Preferably, the clean-out tool may further be configured to remain in a back-jetting mode when the clean-out fluid is pumped into the bore of the tubular housing at a rate higher than the first flow rate. In this position, a similar portion of the clean-out fluid flows through the mandrel, back up the annular region, and through the back jetting ports.

In the preferred embodiment, the mandrel and connected plunger remain in a raised position during run-in. The plunger is maintained a sufficient distance above the seat to permit sufficient fluid to travel through radial slots in the stem and then up to the back jetting ports without a significant pressure drop. Once the pump rate is raised to an activation rate (referred to above as the "second flow rate"), the plunger is lowered onto the seat, providing for the flow-through mode.

The relative ratio of fluid that flows through the back jetting ports and that flows through the bottom of the tool during the back-jetting mode is a matter of design's choice. This ratio can be adjusted based on the cross-sectional area of the flow slots in the stem, the cross-sectional area of the lower annular region, the cumulative cross-sectional area of the back jetting ports, the size of the flow through area in the seat (or, more technically, the stem in the seat) and the flow restriction from additional components that may be below in a bottom hole assembly.

To provide for this cycling of injection modes, the wellbore clean-out tool also includes a sequencing mechanism. The sequencing mechanism is responsive to a sequence of flow rates applied above the piston. In one aspect, the sequencing mechanism comprises a cylindrical body configured to cycle the mandrel between its back-jetting mode (wherein the flow of clean-out fluids is split according to the operator's needs) and its flow-through mode (wherein virtually all clean-out fluids exit through the lower end of the stem). In one aspect, an intermediate position is provided wherein the mandrel and connected plunger reside between the raised position and the lowered position but the mandrel remains in its back-jetting mode.

Preferably, the sequencing mechanism is a J-slot sequencing mechanism. The J-slot mechanism will cooperate with one or perhaps two pins that are disposed along the tubular housing as a J-slot collar. The pins are configured to ride in slots along the J-slot mechanism to cycle the mandrel and connected plunger between the raised position and the lowered position. In this instance, the pins are fixed from axial movement and ride in the slots of the J-slot channel of the mandrel to restrict axial movement of the mandrel on alternating downward strokes.

Preferably, the clean-out tool will only cycle between a single back-jetting mode and the flow-through mode. This may be worked out by providing a J-slot mechanism that is configured to cycle between three settings, comprising:

(i) a first setting wherein the pin resides in a first slot that places the plunger in the raised position in response to the biasing mechanical force exerted by the spring on the mandrel at the first rate, or any rate below the first rate, allowing the clean-out tool to remain in its back-jetting mode as a default position;

(ii) a second setting wherein the pin moves higher in the first slot in response to the injection of fluids into the wellbore at an increased pumping rate so that the plunger advances to an intermediate position, restricting the plunger from moving down the tubular housing to keep the plunger in its back-jetting mode;

(iii) the first setting again wherein the pin resides in a second slot that keeps the plunger in the raised position in response to the upward biasing force of the spring while pumping at the first rate; and (iv) a third setting wherein the pin moves higher along a third slot in response to the injection of fluids into the wellbore at a second increased rate, or at any rate higher than the second rate, and wherein the plunger slides from the raised position to the lowered position, placing the clean-out tool in its flow-through mode wherein all clean-out fluid flows entirely through the mandrel and the seat.

A method of cleaning out a wellbore using a clean-out tool is also provided. The method first includes running a clean-out tool into the wellbore. The clean-out tool is run in on a lower end of a string of coiled tubing. The clean-out tool is arranged in accordance with the clean-out tool as described above, in any of its embodiments.

The method additionally includes locating the clean-out tool at a selected depth along the wellbore. Preferably, the wellbore has been completed with a string of production tubing. In this instance, the clean-out tool is run into the production tubing in order to clean out fill that may have accumulated within the production tubing and casing.

The method further includes injecting a clean-out fluid down the coiled tubing and into the bore of the tubular housing. This injection is done at a first flow rate. This injection causes a portion of the clean-out fluid to flow through the bottom of the plunger, out of the radial ports of the stem, and then back up the tubular housing where this portion will pass through the lower annular region and then exit the clean-out tool through the back jetting ports. The remaining portion of clean-out fluid will flow out of the stem in the seat. This is a back-jetting mode.

The method also includes further injecting the clean-out fluid down the coiled tubing and into the bore of the tubular housing at a second flow rate. Here, the second flow rate is higher than the first flow rate. This increases a hydraulic force acting on the pressure shoulder of the piston, and causes the mandrel and connected plunger to slide downward along the tubular housing.

As the mandrel and connected plunger move down the tubular housing, the distance of the plunger to the radial slots in the stem will reduce. In this position, the plunger does not restrict the portion of flow exiting the radial slots in the stem, which will flow back up the lower annular region and through the back jetting ports. At this point the clean-out tool remains in its back-jetting mode.

Optionally, flow is dropped back down to the first flow rate. Pump rate is then increased through the clean-out tool, thus increasing hydraulic pressure, until the fluid is pumped at or above the second flow rate. Using a sequencing mechanism, the mandrel and connected plunger move down the tubular housing until the plunger lands on the seat. In this position, all of the clean-out fluid is forced to flow through the distal end of the tubular housing. This is a flow-through mode. The mandrel may be cycled between the back-jetting mode and the flow-through mode using a sequencing mechanism that is sensitive to pump rate.

The sequencing mechanism is preferably a J-slot mechanism. In one aspect, the J-slot mechanism has slots that cycle the plunger between the back-jetting mode and the flow-through mode. The J-slot mechanism is configured to:

(i) maintain the clean-out tool in its raised position while pumping at or below the first pump rate, placing the clean-out tool in a back-jetting mode wherein a portion of the clean-out fluid flows through the back jetting ports;

(ii) maintain the clean-out tool in an intermediate position while increasing pump rate above the first pump rate (which may meet or exceed a second pump rate), and wherein the same portion of the clean-out fluid flows through the mandrel, up the lower annular region and through the back jetting ports;

(iii) upon dropping the pump rate back down to or below the first pump rate, allowing the spring to move the clean-out tool back to its raised position, which again is the back-jetting mode;

(iv) upon raising the pump rate to a rate that meets or exceeds the second pump rate, move the clean-out tool to its lowered position, placing the clean-out tool in a flow-through mode wherein all clean-out fluid is forced through the seat and downstream of the clean-out tool; and (v) repeat the cycle of steps (i) through (iv).

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. The term "well," when referring to an opening in the formation, may be used interchangeably with the term "wellbore."

Description of Selected Specific Embodiments

Figure 1A:
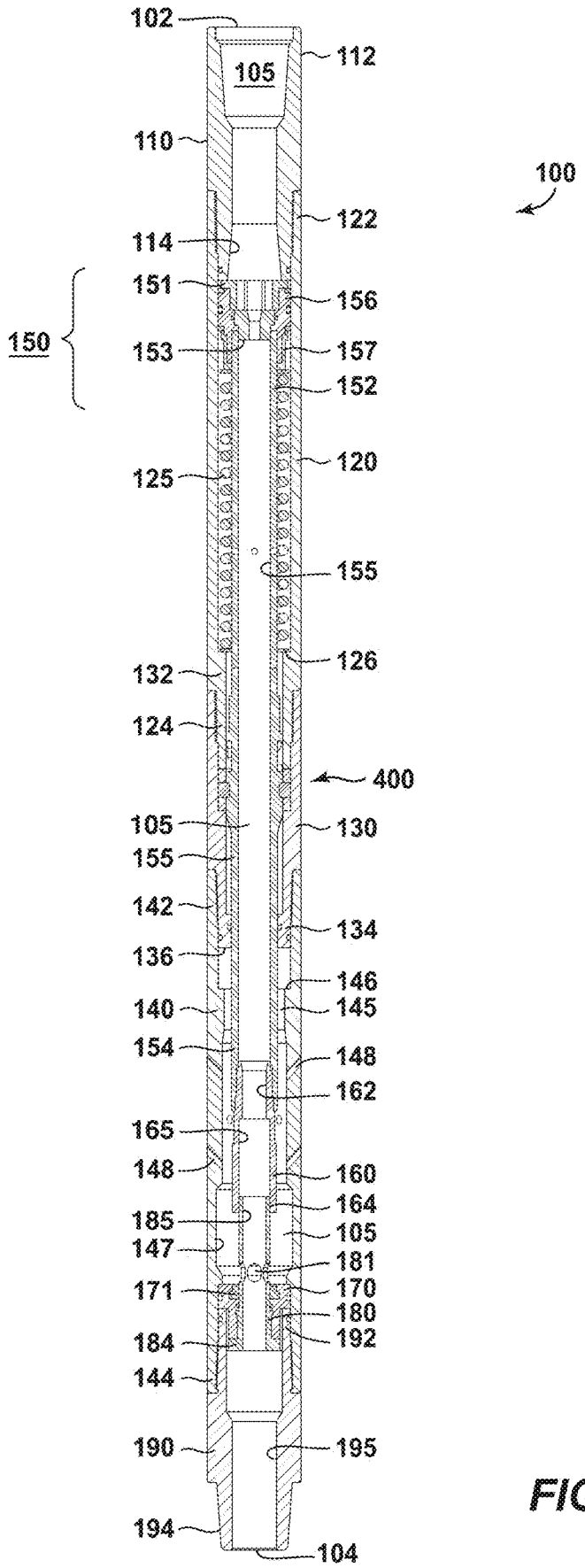
FIG. 1A is a cross-sectional view of a clean-out tool (or "flow diverter") of the present invention, in one embodiment. In this view, the clean-out tool is in its run-in position. During the injection of a clean-out fluid, a significant portion of the injected fluid flows to back jetting ports, while the remainder of the fluid flows through the end of the tool.

FIG. 1A is a cross-sectional view of a clean-out tool (or "flow diverter") 100 of the present invention, in one embodiment. The clean-out tool 100 is used to inject fluids into a wellbore for clean-out. An illustrative wellbore is shown at 1200 in FIG. 12 and is discussed below.

The clean-out tool 100 defines a generally tubular body formed from a series of components. As shown, the clean-out tool 100 has a first (or upstream) end 102 and a second (or downstream) end 104. A central bore 105 is formed within the body extending from the first end 102 to the second end 104.

As will be discussed, the clean-out tool 100 is configured to cycle a position of a mandrel 155 and connected plunger 160 in response to fluid pumping rates into the wellbore 1200 by an operator. In this way, a flow of clean-out fluid through the tool 100 may be adjusted. In the view of FIG. 1A, the clean-out tool 100 is in its run-in position wherein a portion of the injected fluid flows through the tool 100 from the top (or upstream) end 102 to the bottom (or downstream) end 104 en route to a next downhole tool or to the bottom of the wellbore 1200, as the case may be. At the same time, at least some of the injected fluid will exit a back jet housing 140 and exit the clean-out tool 100 through radial back jetting ports 148.

The clean-out tool 100 first includes a top sub 110. The top sub 110 defines a tubular body wherein a first (or upstream) end 112 comprises female threads while a second (or downstream) end 114 comprises male threads. The female threads are configured to threadedly connect to a bottom hole assembly (or "BHA") above (not shown). The upper BHA, in turn, is connected to a string of coiled tubing or other working string, such as through a CT connector (not shown).

The clean-out tool 100 next includes a spring housing 120. The spring housing 120 also defines a generally tubular body wherein a first end 122 comprises female threads while a second opposite end 124 comprises male threads. The first end 122 of the spring housing 120 threadedly connects to the second (or downstream) end 114 of the top sub 110.

The clean-out tool 100 also includes a spring 125. The spring 125 resides along an inner diameter of the spring housing 120. The spring 125 is held in compression within the tool 100. In one aspect, the spring 125 is an Inconel® spring. Alternatively, the spring material is 17-7 stainless steel. Of interest, a shoulder 126 resides along an inner diameter of the spring housing 120. The shoulder 126 serves as a face against which the spring 125 resides.

Moving down the tool 100, the clean-out tool 100 next includes a mandrel seal sub 130. The mandrel seal sub 130 also defines a generally tubular body wherein a first (or upstream) end 132 comprises female threads while a second opposite (or downstream) end 134 comprises male threads. The upstream end 132 threadedly connects to the second (or downstream) end 124 of the spring housing 120. Of interest, the mandrel seal sub 130 encompasses a portion of a sequencing mechanism 400, discussed below.

The clean-out tool 100 also comprises a back jet housing 140. The back jet housing 140 also defines a generally tubular body wherein a first (or upstream) end 142 comprises female threads while a second (or downstream) opposite end 144 also comprises female threads. The back jet housing 140 resides downstream from the top sub 110 and the spring housing 120. The first end 142 of the back jet housing 140 threadedly connects to the second end 134 of the mandrel seal sub 130.

Of importance, the back jet housing 140 comprises one or more back jetting ports 148. The back jetting ports 148 are placed within the back jet housing 140 at an upward angle. Preferably, the angle is between 10° and 60°, and more preferably at about 45° from the central longitudinal axis. The back jetting ports 148 may be also be disposed radially about the back jet housing 140, such as at 15° radially. Preferably, a plurality of back jetting ports 148 are placed radially around the back jet housing 140 along at least two levels.

The spring housing 120, the seal sub 130 and the back jet housing 140 together make up a tubular housing for the clean-out tool 100. Of interest, a shoulder 146 resides along an inner diameter of the back jet housing 140. The shoulder 146 forms a profile above the back jetting ports 148. A separate shoulder 136 resides at the bottom end 134 of the mandrel seal sub 130. O-rings are placed inside the bottom end 134, helping to keep clean-out fluid from flowing from the annular area between the mandrel 155 and the spring housing 120 and to the ports 148 during the flow-through mode.

The clean-out tool 100 additionally includes a piston assembly 150. The piston assembly 150 defines a series of components that are configured to slide together along the spring housing 120 in response to fluid pressure. The piston assembly 150 includes an orifice retainer 151, a piston body 156, a piston orifice 153 and a piston scraper retainer 157. The piston assembly 150 essentially serves as a pressure shoulder, moving down the spring housing 120 in response to fluid pressure applied from the surface.

It is observed here that while it is pressure that moves the piston assembly 150 down, it is also accurate to refer to changes in flow rate that actuate the piston assembly 150. This is because the piston orifice 153 is configured according to a desired flow rate to cause the tool 100 to change between modes. In this respect, the orifice 153 is sized to generate the required differential pressure across itself to function. External pressures do not have an impact on the piston assembly 150; only pressure from the flow rate through the orifice 153 changes the tool mode.

The orifice retainer 151 secures the piston assembly 150 in place below the top sub 110. The orifice retainer 151 abuts the lower end 114 of the top sub 110 to hold the piston assembly 150 in place. Various o-rings (not numbered) may be disposed around the piston body 156 and the piston orifice 153 to prevent pressure communication between the area above the piston assembly 150 and below the piston assembly 150. Additional details concerning the piston assembly 150 are provided below in connection with FIGS. 8A through 8C.

As stated above, the piston assembly 150 is operatively connected to a mandrel 155. The mandrel 155 has an upper (or upstream) end 152 connected to the piston assembly 150, and a lower (or downstream) end 154. The upper end 152 of the mandrel 155 is threadedly connected to the piston body 156. The piston assembly 150 and connected mandrel 155 reside within the inner diameter of the spring housing 120.

In operation, hydraulic pressure (generated by fluid flow through the piston orifice 153) acts on the shoulder that is the upper side of the piston assembly 150 above the piston orifice 153. In response, the piston assembly 150 and connected mandrel 155 move down the tubular housing together. Specifically, the piston assembly 150 (and connected mandrel 155) moves from its raised position (shown in FIG. 1A), to an intermediate position (shown in FIG. 1B) and then to a lowered position (shown in FIG. 1C).

An annular area 145 is reserved between the mandrel 155 and the surrounding back jet housing 140. The annular area 145 has an upper portion where the spring 125 resides, and a lower portion where back jetting ports 148 are placed. Appropriate o-rings reside around and inside the downstream end 134 of the mandrel seal sub 130 to provide a fluid seal between the upper and lower annular regions 145. The annular region the spring 125 resides in is pressure balanced via ports in the mandrel 155. These ports let the fluid volume inside the spring housing 120 change as the piston body 156 moves up and down.

It is observed that the back jet housing 140 has an enlarged inner diameter portion 147. This has the effect of increasing the cross-sectional area of the lower portion of the annular region 145. The larger cross-sectional area enables a free flow of clean-out fluid en route to the ports 148. Clean-out fluid is used to clean the wellbore within the casing, preferably at the conclusion of or in conjunction with a completion operation. Alternatively, clean-out fluid may be used to clean production tubing following a period of production or other wellbore operation.

At the lower end 154 of the mandrel 155 is a plunger 160. The plunger 160 defines a short tubular body having an upper (or upstream) end 162 and an opposing lower (or downstream) end 164. A bore 165 is formed from the upper 162 to the lower 164 end, allowing the clean-out fluid to flow through the plunger 160. The upper end 162 comprises male threads that connect to the lower end 154 of the mandrel 155. In this way, the plunger 160 moves up and down along the bore 105 of the clean-out tool 100 with the mandrel 155.

As a next component, the clean-out tool 100 includes a bottom sub 190. The bottom sub 190 defines an elongated tubular body having an upper end 192 and a lower end 194. The upper end 192 comprises male threads that connect to the bottom end of the back jet housing 140. The bottom sub 190 forms a bore 195 that is in fluid communication with and forms a part of the bore 105.

Finally, the flow diverter 100 comprises a seat 170. The seat 170 shown in FIG. 1A is a standard seat having a flow-through orifice 175. The seat 170 is configured to receive the lower end 164 of the plunger 160 when the piston body 150 is moved to a lowered position (seen in FIG. 1C). The orifice 175 is sized to provide little to no restriction in downhole fluid flow.

In a preferred embodiment, the orifice 175 of the seat 170 receives a stem 180. The stem 180 defines an elongated tubular body. The stem 180 has a proximal (or upper) end 182 (shown in FIGS. 10A and 10B) and a distal (or downstream) end 184. A bore 185 extends from the proximal end 182 to the distal end 184. Flow-through slots 181 are provided along the stem 180. Preferably, four equi-radially disposed slots 181 are provided. Additional details concerning the stem 180 are provided and discussed below in connection with FIGS. 10A-10C.

In the view of FIG. 1A, the piston body 150 is at is uppermost position. This is its default (or raised) position wherein the orifice retainer 151 is abutting the lower end 114 of the top sub 110. The piston body 150 is held in this default position due to the upward mechanical force provided by the spring 125.

As noted, a piston o-ring may be disposed around the piston body 156 to prevent pressure communication between the area above the piston body 156 and below the piston body 156 when fluid is passing through the orifice 153. Additionally, an orifice o-ring may be disposed around the orifice 153 to prevent pressure communication between the area above the orifice 153 and below the orifice 153 when fluid is passing through the orifice 153. The aperture size of the orifice 153 defines the activation rate. Thus, one aspect of using the multi-cycle wellbore clean-out tool 100 involves the selection of the aperture size of the piston orifice 153.

In the raised position of FIG. 1A, fluid is injected by an operator into the bore 105 of the clean-out tool 100 under a first pressure. The first pressure correlates to a first flow rate. Those of ordinary skill in the art will understand that there is a correlation between flow rate, tubular dimension and pressure. At the first flow rate, the hydraulic pressure acting on the piston assembly 150 is not great enough to cause the piston assembly 150 to compress the spring 125.

In the position of FIG. 1A, the plunger 160 extends only partially over the stem 180. Specifically, the plunger 160 remains above the four radially-disposed slots 181. As clean-out fluid is injected into the wellbore 1200 at the first flow rate, fluid will pass through the bore 165 of the plunger 160. A portion of the injected fluid will travel through the slots 181, back up the annular region 145 and up to the back jetting ports 148. The remaining portion of the fluid will flow through the stem 180, below the seat 170 and optionally on to other tools downhole.

In one optional embodiment of the invention, a back pressure valve (not shown) is placed below the bottom sub 190. The back pressure valve can either be threaded to the distal end 194 of the bottom sub 190 or it can be used as the bottom sub 190 itself. The back pressure valve works on the principle of biasing force of a spring which blocks the flow of fluids through a passage. The pressure of the fluids above act on an area and against the spring. The user can adjust the force of the spring, which in turn will adjust the force it takes to open an area of flow to the tools below the sub 190.

In the present application, a back pressure valve can be configured to divert all of the flow to the back jetting ports 148 up to a pre-determined pressure, set by the operator. For example, if the planned back jetting rate corresponds to a 200 psi pressure drop across the back jetting ports 148, the back pressure valve can be set to open at 300 psi. When the tool 100 is in its back-jetting mode, all of the flow will go to the ports 148. When the plunger 160 contacts the seat 170 for flow-through mode, the back pressure valve will be forced open at 300 psi and will provide a pressure indication. This is useful when the operator wants to pump a fluid that it does not want to go through the tools below when in back-jetting mode, such as an acid or nitrogen.

In another embodiment, a positive displacement motor is used below the bottom sub 190, wherein the motor has a high off-bottom pressure. In this instance, virtually all of the injected fluid in the plunger's raised position will be diverted to the back jetting ports 148.

It is understood that the percentage of fluids flowing back through the ports 148 during the back-jetting mode is a function of various factors. These include the diameter of the ports 148, the number of the ports 148, the combined cross-sectional area of the flow through slots 181, and the cross-sectional area of the annular region 145. In addition, the total volume of fluid pumped through the clean-out tool 100 is a function of the inner diameter of the piston orifice 153 and the diameter of the bore 105. Therefore, as part of a method of cleaning out a wellbore herein, the operator determines the number of ports to be used, the size of the ports, the inner diameter of the piston orifice 153, the area of the slots 181, the diameter of the bore 155 and the size of the annular region 145 around the bore 155. These steps are indicated at Box 1360 of the flow chart of FIG. 13, discussed below.

Once the wellbore clean-out tool 100 is run into the wellbore 1200, the operator will begin pumping. During pumping, the operator will increase the pump rate. This will apply a greater hydraulic force to the shoulder of the piston assembly 150 and will start to overcome the biasing force of the spring 125 (plus any friction created by o-rings). The piston assembly 150, the mandrel 155 and its connected plunger 160 will then start to move down the bore 105.

Figure 1B:
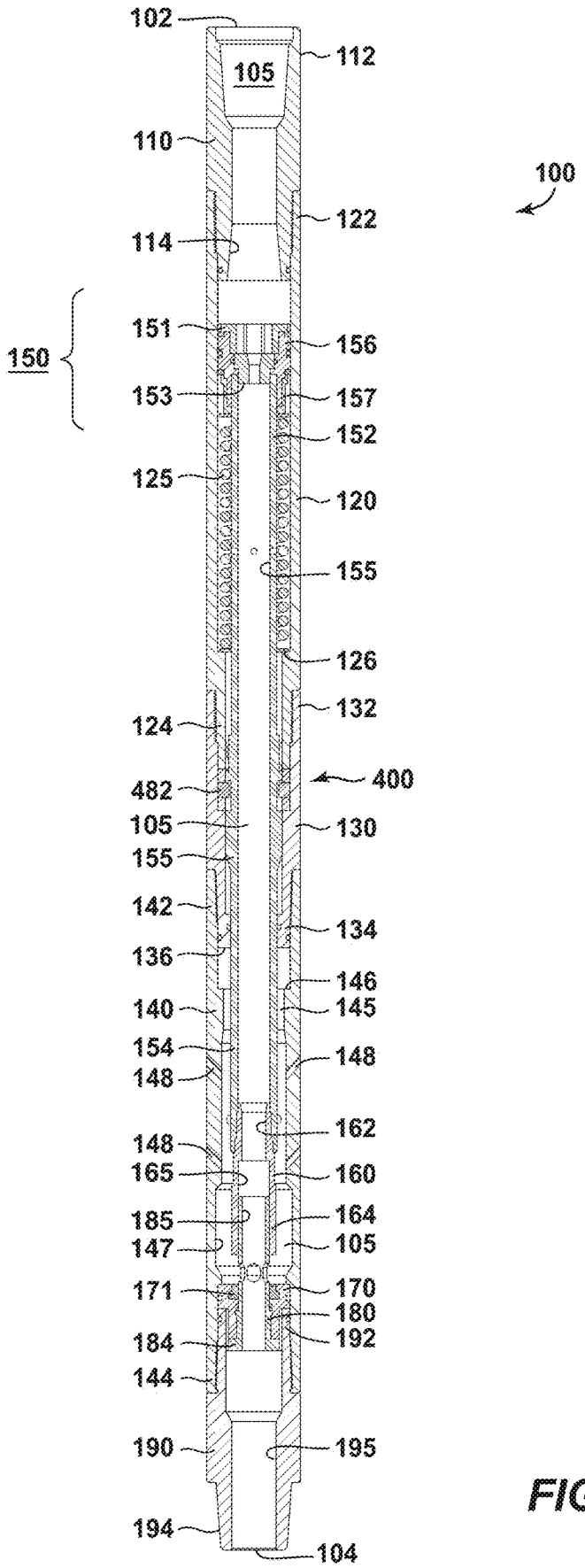
FIG. 1B is a second cross-sectional view of the clean-out tool of FIG. 1A. Here, the clean-out tool has been cycled to an intermediate position. In this position, a significant portion of the injected fluid continues to flow to the back jetting ports while the remainder of the fluid flows through the end of the tool.

FIG. 1B is a cross-sectional view of the clean-out tool 100 of FIG. 1A. Here, the clean-out tool 100 is translating (that is, sliding down the spring housing 120) to its intermediate position. This is done by increasing the hydraulic force acting on the piston assembly 150. The increased hydraulic force is achieved by increasing pump rate of the hydraulic fluid into the wellbore from the surface. In response to the increased pressure (or increasing flow rate), the piston body 150 and connected plunger 160 have slid down to a position where the lower end 164 of the plunger 160 approaches the radial slots 181 in the stem 180. However, it is important to note that in this intermediate position the tool 100 remains in its back-jetting mode.

Figure 1C:
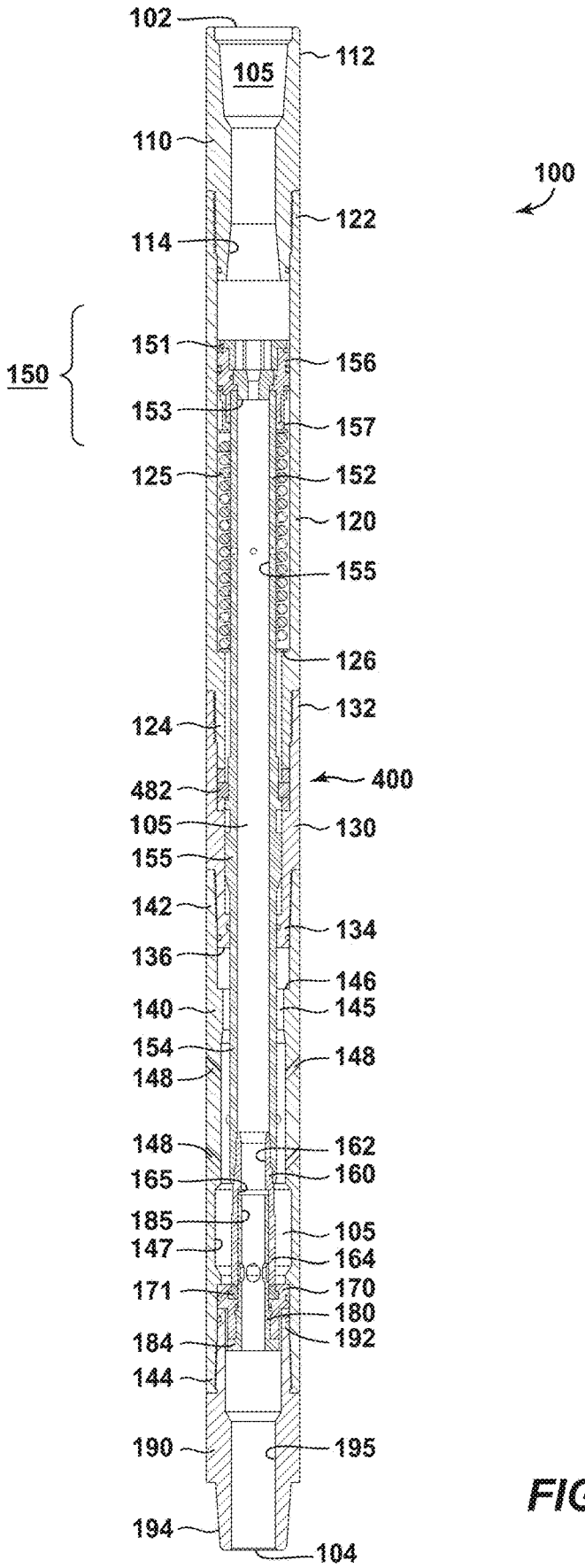
FIG. 1C is a third cross-sectional view of the clean-out tool of FIG. 1A. Here, the tool has been cycled to its fully lowered position. In this position, a plunger has landed on a seat, and all of the injected fluid travels through the flow diverter, with virtually no clean-out fluid being diverted to the back jetting ports.

FIG. 1C is a third cross-sectional view of the clean-out tool of FIG. 1A. Here, the clean-out tool 100 has been cycled to its lowered position. This is done by further increasing the pump rate above an activation rate, thereby increasing the hydraulic force acting on the shoulder that is the piston assembly 150. As the plunger 160 moves below the radial slots 181, a greater percentage of the clean-out fluid will flow down through the seat 170, into the bore 195 of the bottom sub 190, and out of the tool 100.

The cycling of the tool 100 between its raised position (FIG. 1A), its intermediate position (FIG. 1B) and its lowered position (FIG. 1C) is preferably accomplished by using a sequencing mechanism. The sequencing mechanism is preferably a J-slot mechanism as shown in FIGS. 4A-4D, discussed below. The sequencing mechanism 400 allows the operator to cycle the flow rates to move the tool 100 between settings so that:

(i) in a first setting, the plunger 160 is in a raised position in response to the biasing mechanical force exerted by the spring 125 on the mandrel 155, placing the clean-out tool in a back-jetting mode;

(ii) in a second setting, pumping rate is increased and the J-slot mechanism 400 advances to a next slot, allowing the plunger 160 to move down no more than to its intermediate position and allowing the operator to inject hydraulic fluid into the bore 105 of the tubular housing 110 and through the piston orifice 153 at a second rate, or at any rate higher than the second rate, and keeping the clean-out tool in its back-jetting mode;

(iii) in the first setting again, hydraulic pumping rate is reduced to its first rate, or any rate below the first rate, and the clean-out tool 100 remains in its back-jetting mode; and (iv) in a third setting, the plunger 160 is forced down into a lowered position in response to the injection of hydraulic fluid through the piston assembly 150 and into the clean-out tool 100 at a second rate, or at any rate higher than the second rate, moving the J-slot mechanism 400 to a next slot and causing the plunger 160 to slide from the raised position to the lowered position, placing the clean-out tool 100 in its flow-through mode.

It is observed in FIG. 1C that the piston body 150 has lowered the plunger 160 down to a position where the plunger 160 has landed onto the seat 170. In this position, all of the injected fluids travel through the lower end 184 of the stem 180 and to the bottom end 104 of the flow diverter 100, with essentially no fluids being diverted to the back jetting ports 148.

In the diverter tool 100 of FIGS. 1A-1C, the stem 180 is a standard-sized stem that simply receives the plunger 160 when the piston body 150 is urged down to its lowered position. The O.D. of the stem 180 is configured to slidably receive the lower end 164 of the plunger 160 until the plunger 160 passes below the slots 181 in the stem 180. This may be referred to as "landing the plunger on the seat" as the plunger 160 is contacting a seal which is considered as integral to the seat 170. No significant pressure drop takes place through the standard stem 180. However, the operator may believe that the standard stem 180 allows too much fluid to pass through the bottom end 104 of the flow diverter 100, limiting the amount of pressure provided by fluids passing through the back jetting ports 148. In this instance, the operator may choose to use a restricted orifice seat. This is done by reducing the I.D. of the stem 180.

Figure 2A:
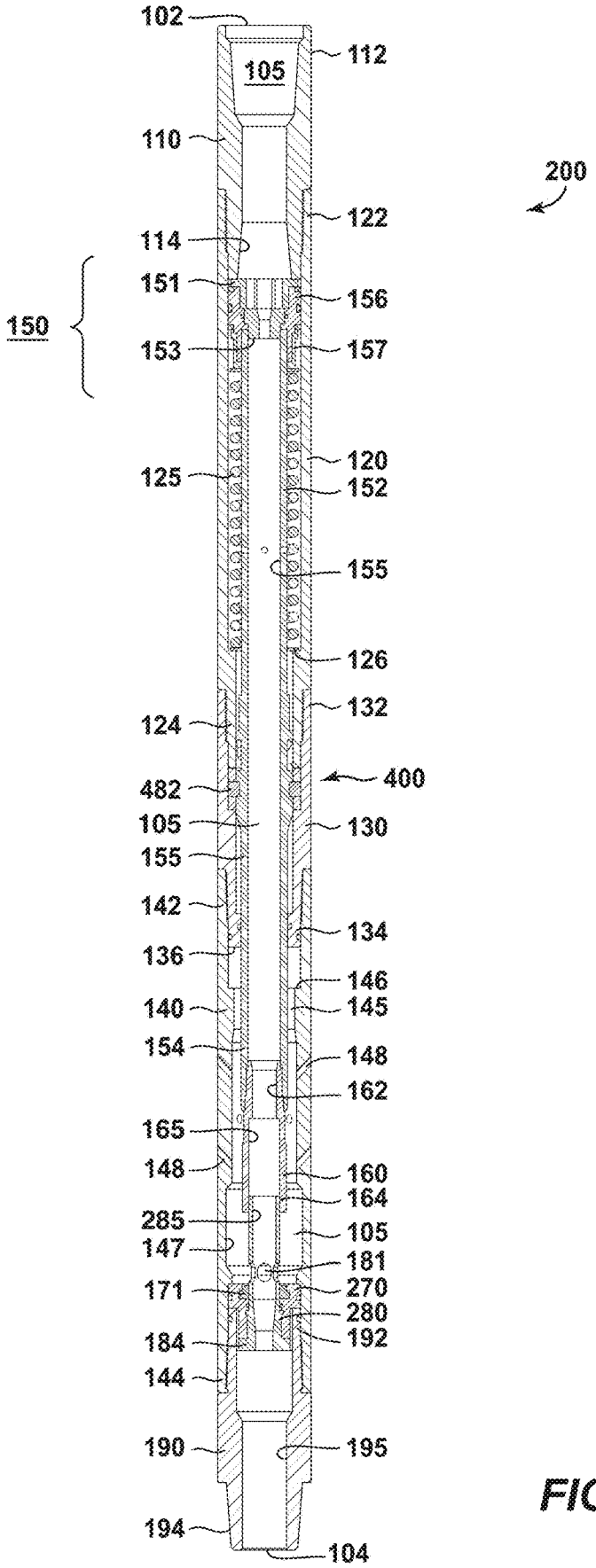
FIG. 2A is a cross-sectional view of a clean-out tool of the present invention, in a second embodiment. In this view, the clean-out tool is again in its run-in position wherein a significant portion of injected clean-out fluid flows to back jetting ports, while a remaining portion flows through the end of the tool. In this embodiment, a more restricted orifice is used in the seat.

FIG. 2A is a cross-sectional view of a clean-out tool 200 of the present invention, in a second embodiment. In this view, the clean-out tool 200 is again in its run-in position wherein a substantial portion of injected fluid flows to the back jetting ports 148, while the remaining fluid flows through the bottom sub 190 of the tool 200 en route to a next downhole tool. The clean-out tool 200 is built in accordance with the clean-out tool 100 described above. However, in this design a restricted orifice stem 280 has been placed below the plunger 160 in lieu of the stem 180. The restricted orifice stem 280 has a more restrictive through opening 285, limiting the amount of working fluid that can pass through the stem 280.

Beneficially, the stem 280 provides a better indicator at the surface as to the position of the plunger 160 (via pump pressure) during cycling. Also as noted, the use of the restricted-orifice stem 280 and its flow-through opening 285 directs a greater percentage of injected fluid to the back jetting ports 148. For example, in the embodiment of FIG. 2A the percentage of redirected fluid might be 30% to 40%, or 40% to 50%, or 50% to 90% of the injected fluid. This is true even where the components below the tool 100 have low back pressure.

Figure 2B:
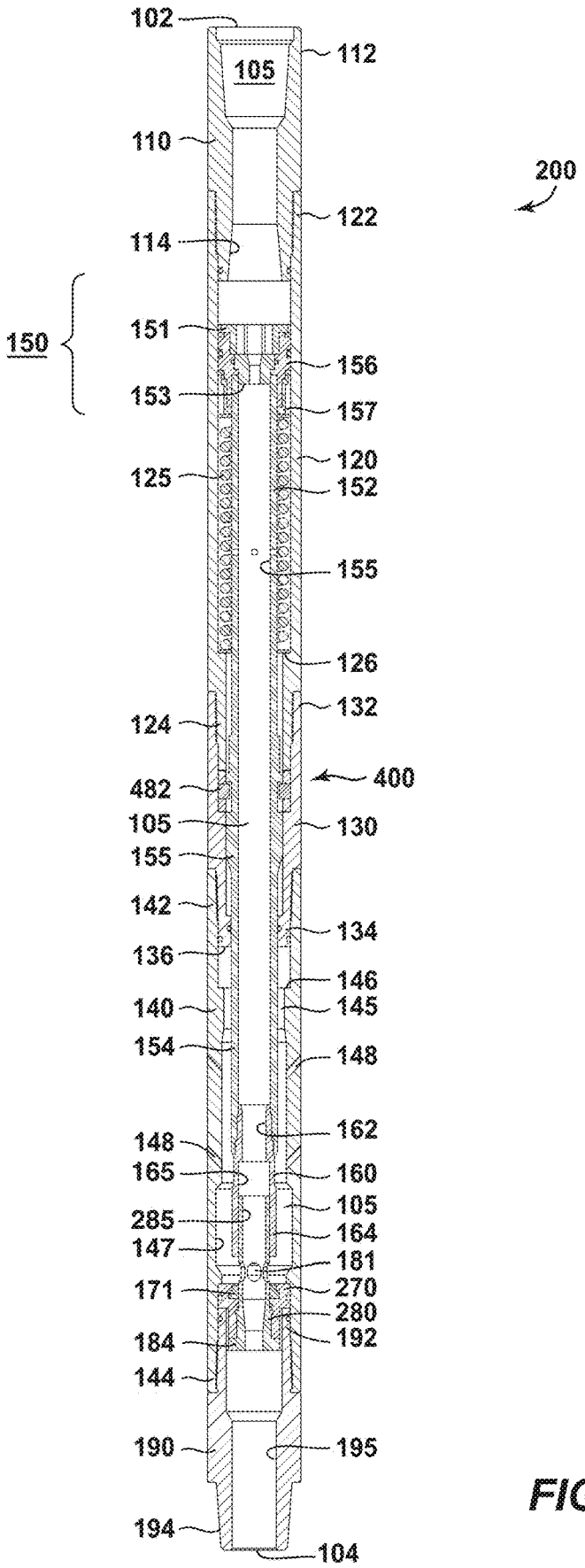
FIG. 2B is a cross-sectional view of the flow diverter of FIG. 2A. Here, the flow diverter has been cycled to an intermediate position. In this position, a significant portion of the injected fluid continues to flow to the back jetting ports while the remainder of the fluid flows through the end of the tool.
Figure 2C:
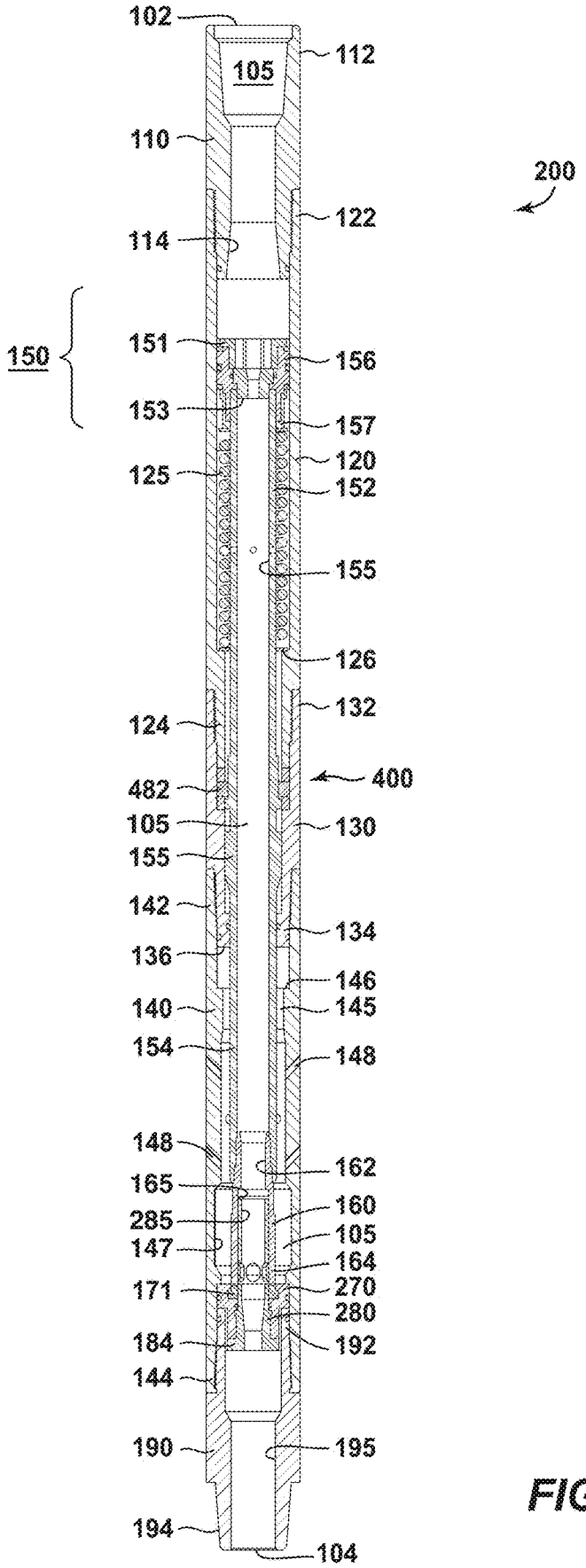
FIG. 2C is a third cross-sectional view of the flow diverter of FIG. 2A. Here, the tool has been cycled to its lowered position. In this position, the plunger has landed on the seat, with virtually no clean-out fluid being diverted to the back jetting ports.

As with the clean-out tool 100 of FIG. 1A, the clean-out tool 200 of FIG. 2A is configured to move from its raised position (FIG. 2A) down to its lowered position (FIG. 2C). This again is done through the use of a cycling mechanism, such as the J-slot mechanism 400 shown in FIGS. 4A through 4D.

FIG. 2B is a cross-sectional view of the clean-out tool 200 of FIG. 2A. Here, the clean-out tool 200 is translating from its raised position to its intermediate position. En route, a portion of the injected fluid will continue to be diverted through the radial slots 181 and on to the back jetting ports 148. As with the embodiment of FIG. 1B, a portion of the hydraulic fluid will flow back up the lower annular region 147, and then through the back jetting ports 148. The remaining portion of injected fluid will continue to flow down through the stem 280, into the bore 195 of the bottom sub 190, and out of the tool 200. Because the orifice 285 is restricted, this will urge a greater portion of injected clean-out fluid to travel back to the back jetting ports 148.

FIG. 2C is a third cross-sectional view of the flow diverter 200 of FIG. 2A. Here, the flow diverter 200 has been cycled to its fully lowered position. In this position, all of the injected fluid travels through the flow diverter 200, with substantially no clean-out fluid being diverted to the back jetting ports 148. This may be done by increasing hydraulic pressure within the bore 105 of the clean-out tool 200 from the first pressure to the second greater activation pressure. Hydraulic pressure again is increased by increasing pump rate from the surface.

It is observed that in each of the views of FIGS. 1A-1C and 2A 2C, no tool is shown below the bottom sub 190. However, the bottom end 194 of the sub 190 is configured to threadedly connect to a separate tool that may be placed in the wellbore 1200 below the clean-out tool 100 or 200. For example, a positive displacement motor (presented at 300A in FIG. 3A) may be placed downstream from the clean-out tool 200. In this instance, the restricted-orifice stem 280 replaces the standard-sized stem 180 to provide an improved feedback signal through pressure increase of approximately 200 psi (with 1.01 SG Fluid) at the same pump-rate to indicate the flow-through mode. Additionally, the restricted-orifice stem 280 provides a secondary function of limiting the flow to the motor 300A while in back-jetting mode.

Figure 3A:
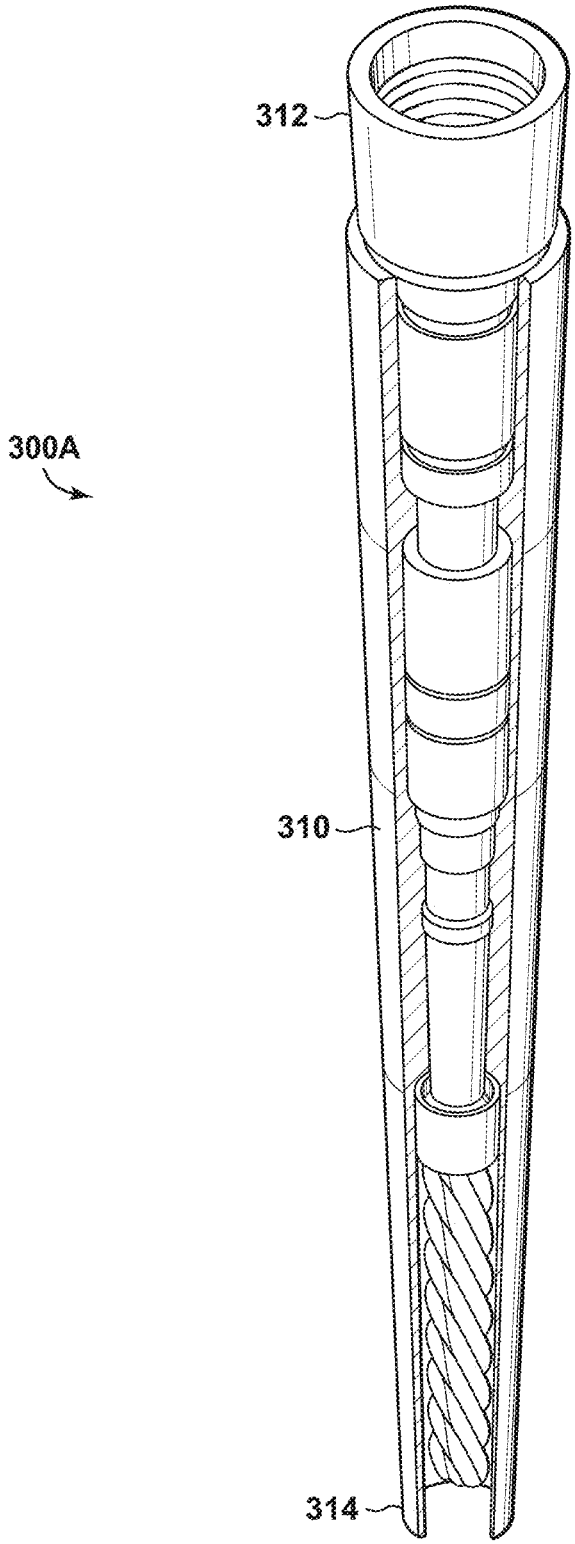
FIG. 3A is a perspective view of a positive displacement motor as may be placed below the clean-out tool of either FIG. 1A or FIG. 2A.

FIG. 3A is a perspective view of a positive displacement motor 300A. This provides an example of a tool that may be connected to the bottom sub 190 or otherwise placed below the bottom sub 190 as part of a tool string. The positive displacement motor 300A may be placed below the clean-out tool of either FIG. 1A or FIG. 2A. Preferably, the positive displacement motor 300A would be used in connection with the embodiment 200 of FIGS. 2A-2C. It is understood that the positive displacement motor 300A is merely illustrative; other positive pressure tools may be placed downstream of the seat 170.

Figure 3B:
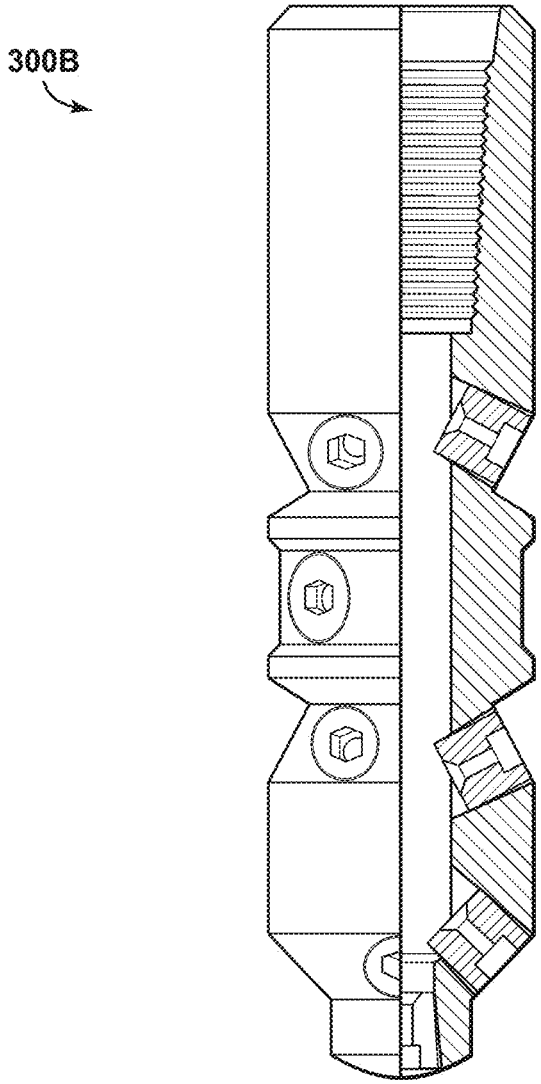
FIG. 3B is a perspective view of a hydraulic jetting nozzle as may be placed below the clean-out tool of either FIG. 1A or FIG. 2A.
Figure 3C:
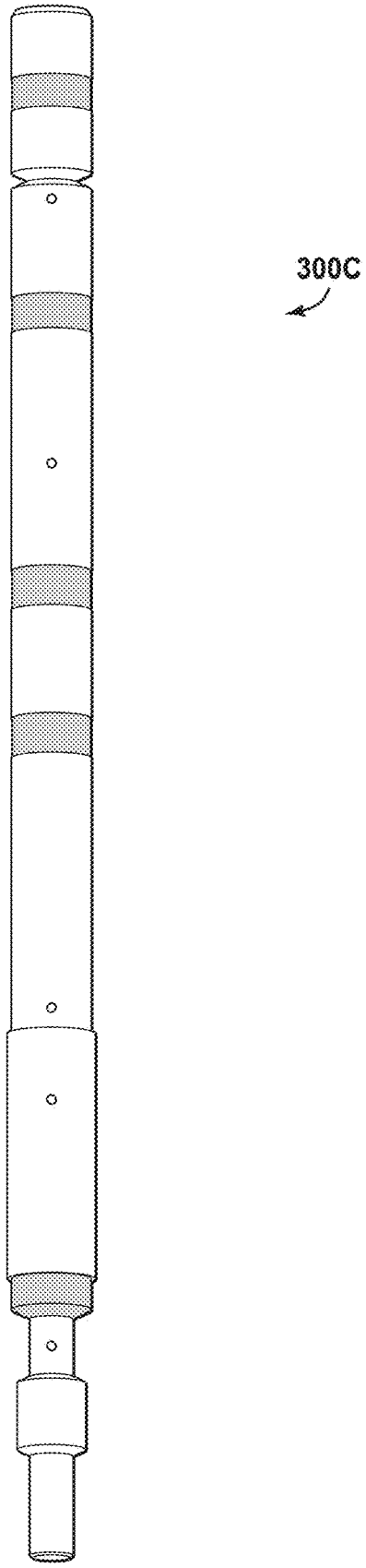
FIG. 3C is a perspective view of a setting tool as may be used in a wellbore.
Figure 3D:
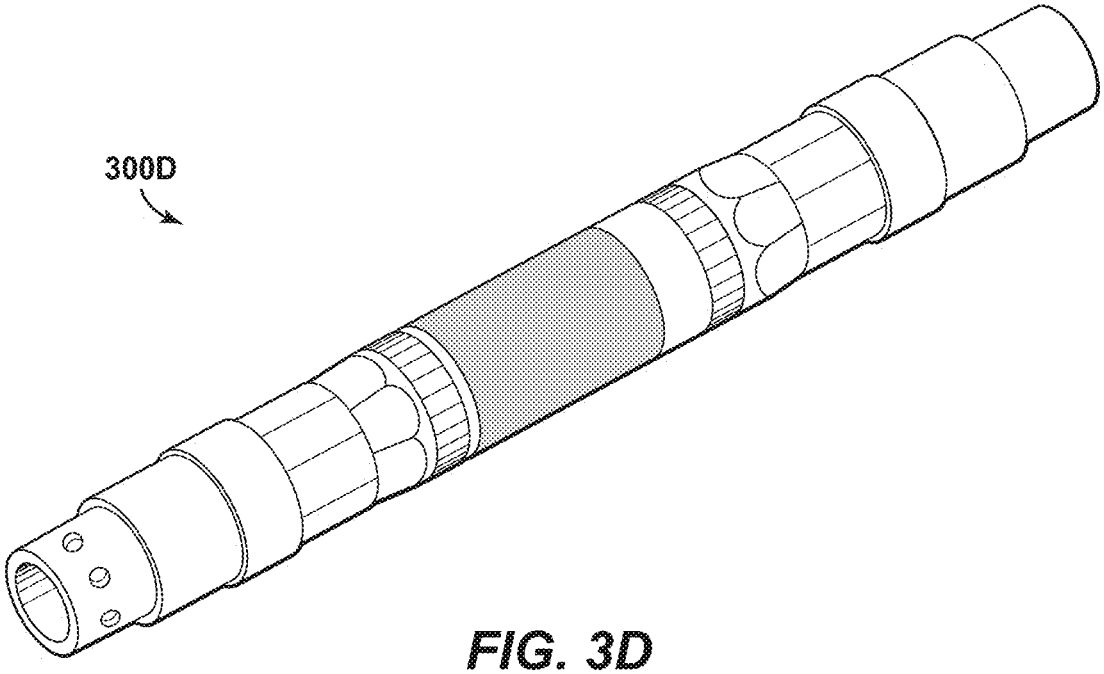
FIG. 3D is an example of a bridge plug that may be set, retrieved or drilled out using a bottom hole assembly that includes the clean-out tool of FIG. 1A or FIG. 2A.

It can be seen that the motor 300A includes an elongated tubular body 310. The body 310 defines a fluid in-take end 312 and a fluid outlet end 314. The positive displacement motor 300A operates with a rotor and a stator residing within the tubular body 310. In one aspect, the positive displacement motor 300A is used as an agitator, sending pressure pulses across the wellbore downhole while cleaning. In another aspect, a small drill bit (such as shown in FIG. 3G) is connected to the outlet end 314, and is turned by the rotor of the motor 300A. The drill bit 300G may also be used for clean-out.

In any instance, the use of the restricted-orifice stem 280 is particularly appropriate if the "off-bottom" pressure of the positive displacement motor 300A is low. However, depending upon the characteristics of the positive displacement motor 300A, the larger orifice 185 provided in the standard stem 180 may also be acceptable to use.

As an alternative to the motor 300A of FIG. 3A, a separate hydraulic nozzle may be placed below the lower sub 190. An illustrative jetting nozzle 300B is shown in FIG. 3B. In this instance, a standard stem 180 would be used. The separate nozzle 300B is preferably the Helix™ nozzle provided by Coil Solutions Inc. of Calgary, Alberta. The nozzle would be used for wellbore clean-out below the tool 100. In an alternative embodiment, and as described further below, a sliding sleeve shifting tool is placed below the bottom sub 190.

FIG. 3B is cut-away view of an illustrative nozzle 300B as may be placed below the wellbore clean-out tool 100. The illustrative nozzle is manufactured by National Oilwell Varco, or NOV, based in Houston, Tex.

In order to move the clean-out tool 100 or 200 through its position cycles, the operator may increase pressures incrementally. Based upon piston orifice 153 I.D., stem 180 or 280 I.D. and total back jetting port 148 through-opening area, the operator will know at what rate to pump for each cycle. For example, the operator will know a second rate to pump that places the plunger 160 at its lowest, or seated position (FIGS. 1C and 2C). The difference in tubular pressure between the two modes at the same pump rate serves as a position indicator for cycling.

To enable the cycling, a sequencing mechanism such as a J-slot mechanism may be provided. A J-slot mechanism is a cylindrical device having a circuitous channel forming slots. One or more pins ride along the slots, rotating from slot-to-slot in response to changes in fluid pressure.

Figure 4A:
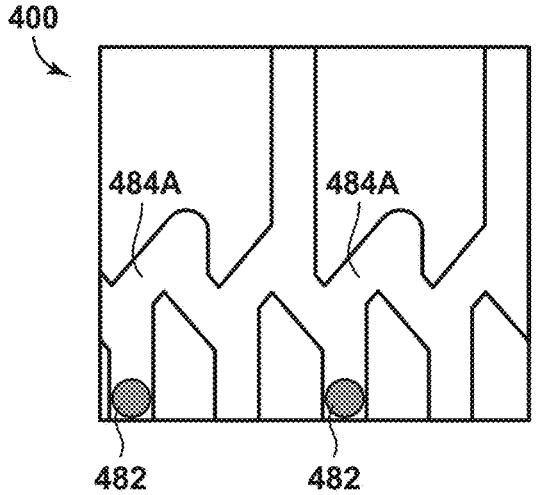
FIG. 4A is a side view of a j-slot mechanism. In this view, pins are in a default position along the slots.

FIG. 4A is a side view of a portion of a J-slot mechanism 400. It can be seen that a pair of pins 482 reside in respective lower slots 484A. This is a slot position that would correlate with the default, or raised position of the plunger 160 as presented in FIGS. 1A and 2A. In this position, the pump rate is below the activation rate. This cycle position will allow injected fluid to flow to the back jet housing 140 while sending the remaining portion of the fluid on through the bottom end 194 of the bottom sub 190.

Figure 4B:
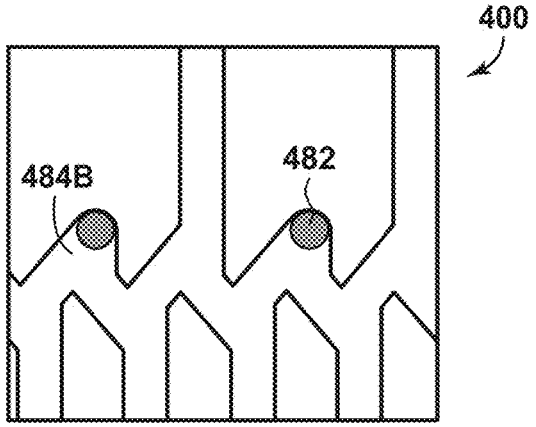
FIG. 4B is another side view of the j-slot mechanism of FIG. 4A. In this view, the pins have advanced along the channel and are in an intermediate position.

FIG. 4B is another side view of the J-slot mechanism 400 of FIG. 4A. In this view, the pins 482 have advanced one slot 484B. In slot 484B, the pins 482 are in an intermediate position. This is a slot position that would correlate to the operator increasing pump rate from the surface as shown in FIGS. 1B and 2B. In this position, the location of the J-slot pins 482 restricts the movement of the plunger 160 while allowing the flow-rate to beneficially move above the activation rate. In other words, the plunger 160 will not advance along the stem 180 even when the pump rate is well above the activation rate, allowing vigorous back jetting through ports 148.

Figure 4C:
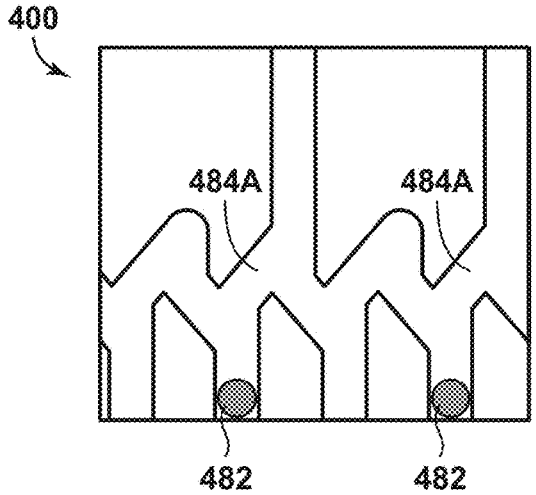
FIG. 4C is another side view of the j-slot mechanism of FIG. 4A. In this view, the pins have advanced along the channel to a second slot but have returned to the default position of FIG. 4A.

FIG. 4C is another side view of the J-slot mechanism 400 of FIG. 4A. In this view, pumping rate has been dropped back below the activation rate, causing the pins 482 to follow along the channel and to advanced one slot 484A. In this position 484A, the plunger 160 has returned to its raised position per FIGS. 1A and 2A.

Figure 4D:
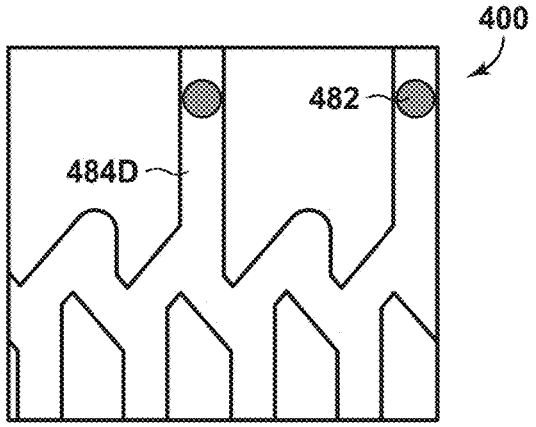
FIG. 4D is still another side view of the j-slot mechanism of FIG. 4A. In this view, the pins have advanced to a new slot along the channel and are now in a fully raised position. In this position, the piston and connected mandrel have moved the plunger of the clean-out tool to its lowered position such that the plunger will land on the seat per FIG. 1C or FIG. 2C.

FIG. 4D is still another side view of the J-slot mechanism 400 of FIG. 4A. In this view, the pump rate has again been increased above the activation rate, causing the pins 482 to advance along the channel to a next slot 484D. In this position, the plunger 160 is seated, isolating the back jetting ports 148 from fluid injection per FIGS. 1C and 2C. In this position, the operator may inject at high rates to operate a motor 300A or to direct all fluids through a downhole jetting nozzle.

The pins 482 advance from slot-to-slot in response to alternating cycles of the piston body 150 and connected internals moving longitudinally. The pins 482 cause the piston assembly 150 and connected internals to ratchet, or rotate, in a circular path. Also, the component housing the J-slot pin or pins 482 may ratchet, or rotate, in a circular path. The J-slot grooves (484A, 484B, 484D) are configured so that the piston body 150 and connected internals travel is unrestricted in the upward direction so that every time the flow rate is brought below the activation rate the plunger 160 is in its raised position and cannot seal against the seat 170 or 270. Additionally, on alternating cycles of the flow rate being brought to or above the activation rate, the J-slot grooves (484A, 484B, 484D) restrict the travel of the piston body 150 and connected internals so the plunger 160 cannot seal against the seat 170 or 270.

Beneficially, the annular area 145 communicating to the back jetting ports 148 remains open for clean-out at rates above the activation rate. On opposite alternating cycles of the flow rate being brought to or above the activation rate, the J-slot grooves (484D) allow the piston body 150 and connected internals to travel further down so that the plunger 160 remains above the radial slots 181 of the stem 280 (FIG. 2B) and then the plunger 160 contacts the seat 270 (FIG. 2C), enabling full flow-through to any tools (such as motor 300A) disposed below the clean-out tool 200.

Figure 5A:
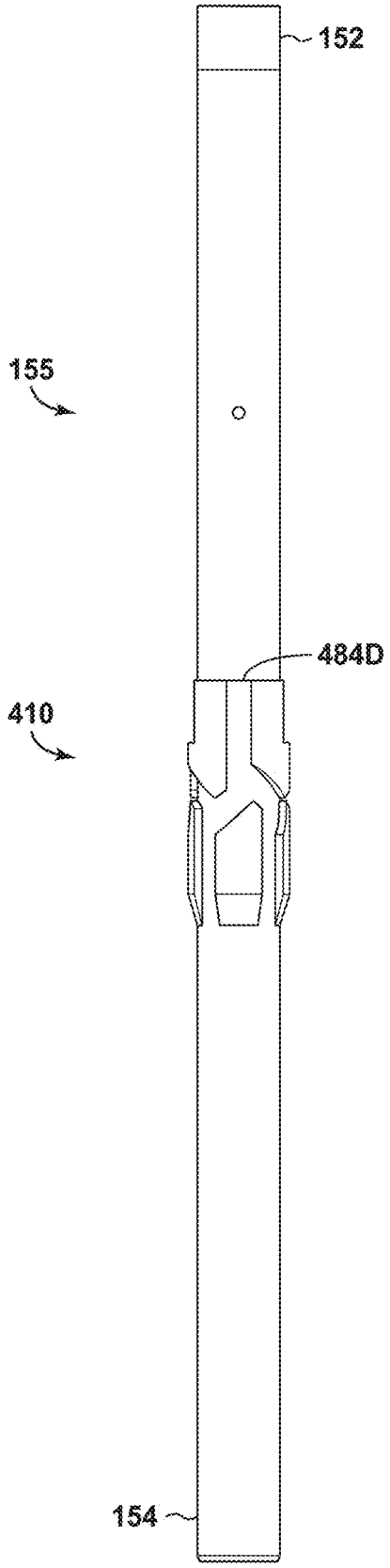
FIG. 5A is side view of the mandrel of FIGS. 1A and 2A. So called J-slots are visible along the outer diameter of the mandrel. These are part of the sequencing mechanism.

FIG. 5A is side view of the mandrel 155 of FIGS. 1A and 2A. So called J-slots 410 are visible along the outer diameter of the mandrel 155.

Figure 5B:
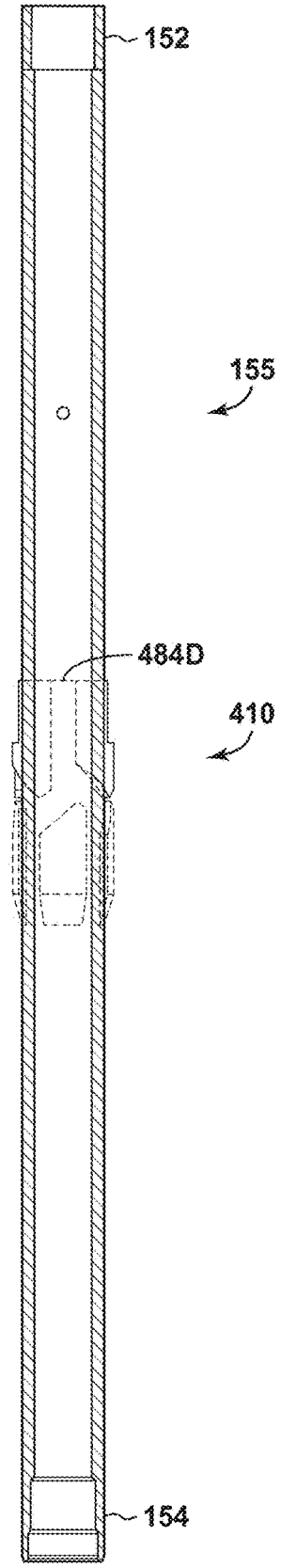
FIG. 5B is a cross-sectional view of the mandrel of FIG. 5A. The view of the J-slots is retained in phantom.

FIG. 5B is a cross-sectional view of the mandrel 155 of FIG. 5A. In both FIGS. 5A and 5B, slot 484D of the J-slots 410 is visible. Here, the J-slots 410 are shown in phantom.

It is understood that the J-slots 410 of FIGS. 5A and 5B are part of the sequencing mechanism 400. The J-slots 410 work in tandem with a J-slot collar (shown at 420 in FIG. 6A).

Figure 6A:
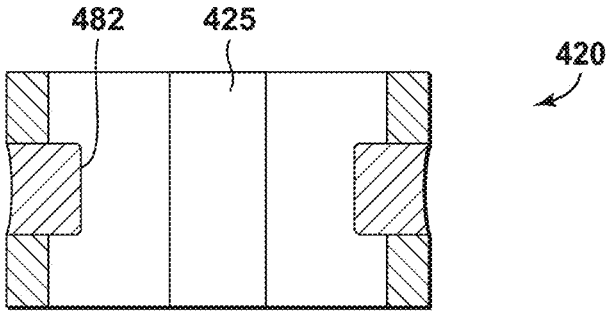
FIG. 6A is cross-sectional view of a J-slot collar. The J-slot collar includes a pair of opposing pins that ride in the J-slots of FIG. 5A. The J-slot collar is also part of the sequencing mechanism.

FIG. 6A is cross-sectional view of a J-slot collar 420. The J-slot collar 420 includes a pair of opposing pins 482 that ride in the J-slots 410 of FIG. 5A.

Figure 6B:
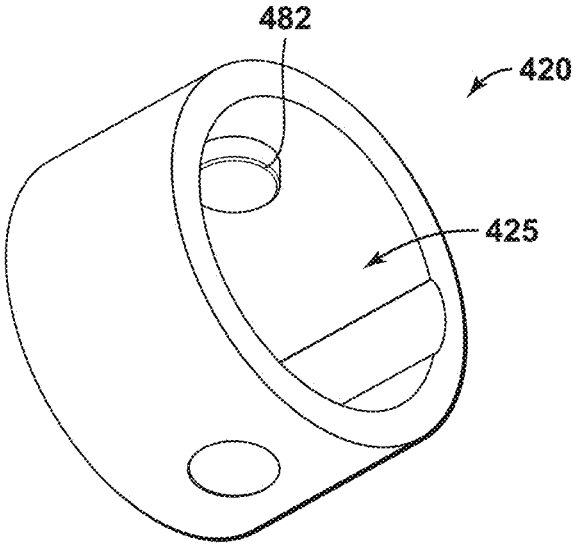
FIG. 6B is a perspective view of the J-slot collar of FIG. 6A.

FIG. 6B is a perspective view of the J-slot collar 420 of FIG. 6A. Visible in this view is one of the pins 482 extending inwardly into a bore 425.

Figure 7:
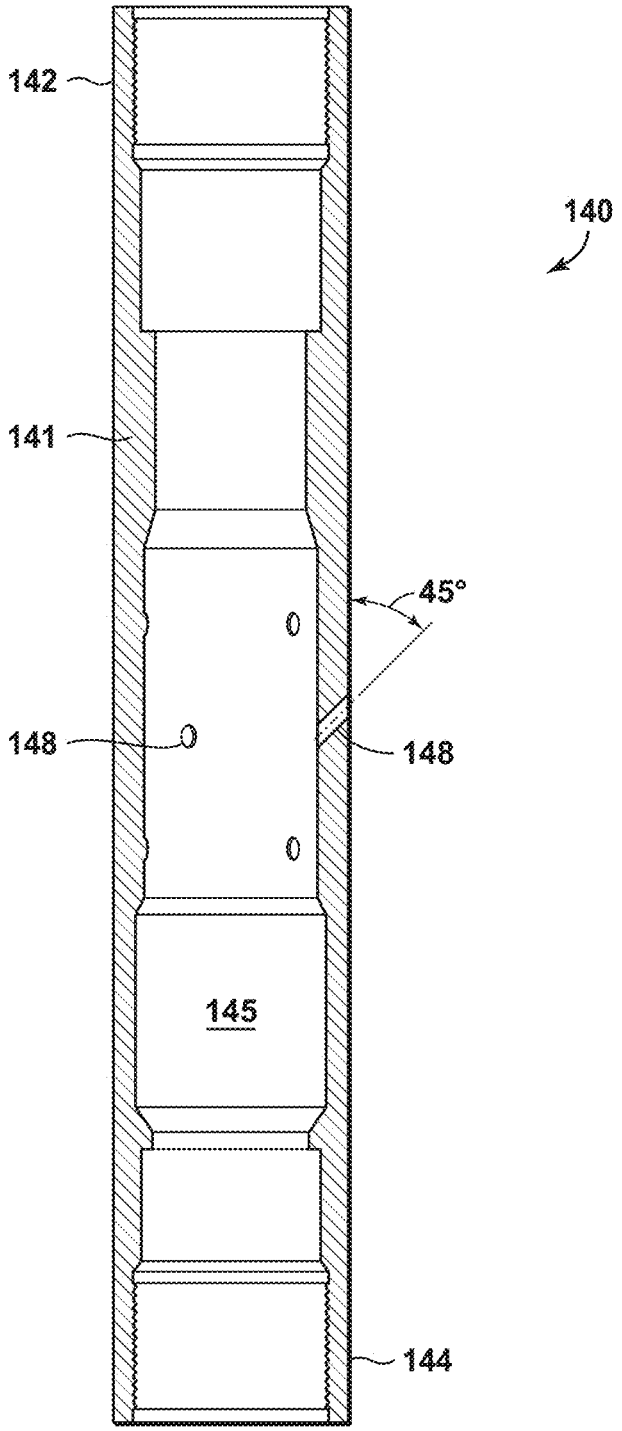
FIG. 7 is a cross-sectional view the back jet housing of FIGS. 1A and 2A. Back jetting ports are visible in the body of the housing.

FIG. 7 is a cross-sectional view the back jet housing 140 of FIGS. 1A and 2A. The proximal (or upstream) end 142 and the distal (or downstream) end 144 are visible. It is observed that the back jet housing 140 defines a wall 141 forming a bore 145. The bore 145 extends from the proximal 142 to the and distal 144 end. The back jetting ports 148 are visible in the wall 141 making up the housing 140.

Figure 8A:
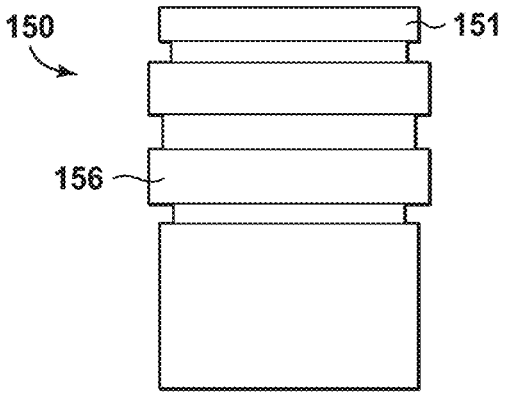
FIG. 8A is a side view of the piston assembly of FIGS. 1A and 2A.

FIG. 8A is a side view of the piston assembly 150 of FIGS. 1A and 2A.

Figure 8B:
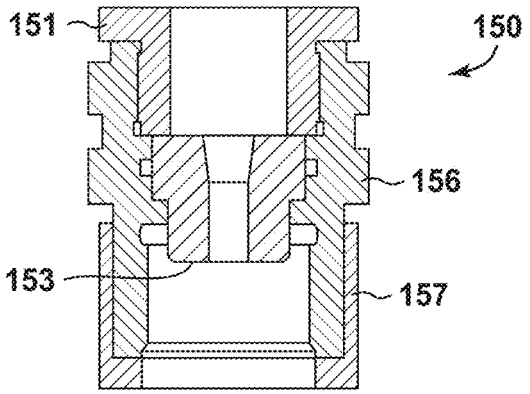
FIG. 8B is a cross-sectional view of the piston assembly of FIG. 8A.

FIG. 8B is a cross-sectional view of the piston assembly 150 of FIG. 8A.

Figure 8C:
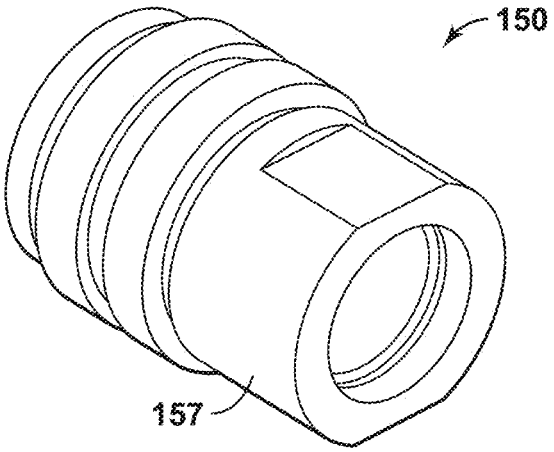
FIG. 8C is a perspective view of the piston assembly of FIG. 8A.

FIG. 8C is a perspective view of the piston assembly 150 of FIG. 8A. The piston assembly 150 will be discussed with reference to FIGS. 8A-8C together.

The piston assembly 150 includes an orifice retainer 151, a piston body 156, a piston orifice 153 and a piston scraper retainer 157. The piston orifice 153 resides below the orifice retainer 151. The piston orifice 153 comprises a shoulder, with the shoulder being exposed to fluid pressure above the fluid assembly 150. The piston orifice 153 includes a central through-opening that permits working fluids to flow through the piston assembly 150 during clean-out operations. Piston scrapers (not shown) may be disposed around the piston body 156 to ensure debris is not able to reach the piston body o-ring.

Figure 9A:
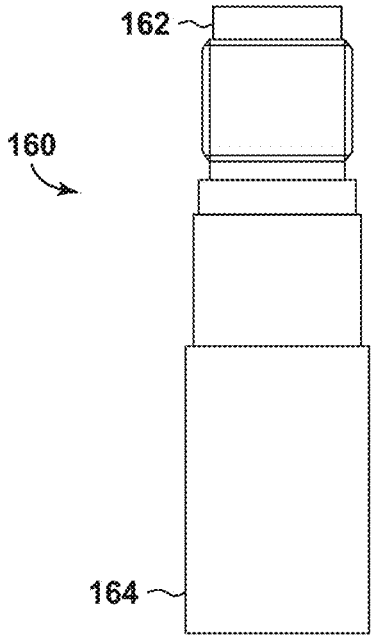
FIG. 9A is a side view of the plunger of FIGS. 1A and 2A.

FIG. 9A is a side view of the plunger 160 of FIGS. 1A and 2A.

Figure 9B:
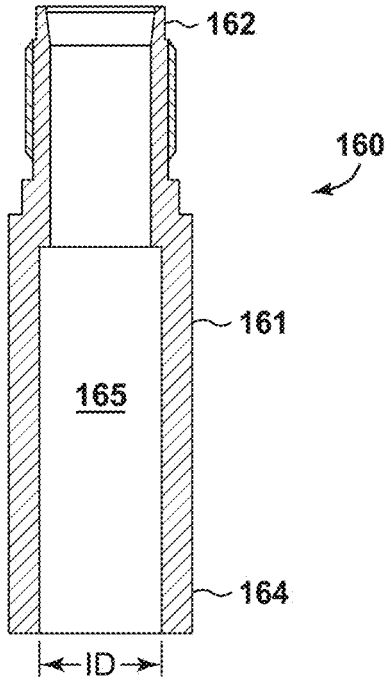
FIG. 9B is a cross-sectional view of the plunger of FIG. 9A.

FIG. 9B is a cross-sectional view of the plunger 160 of FIG. 9A.

Figure 9C:
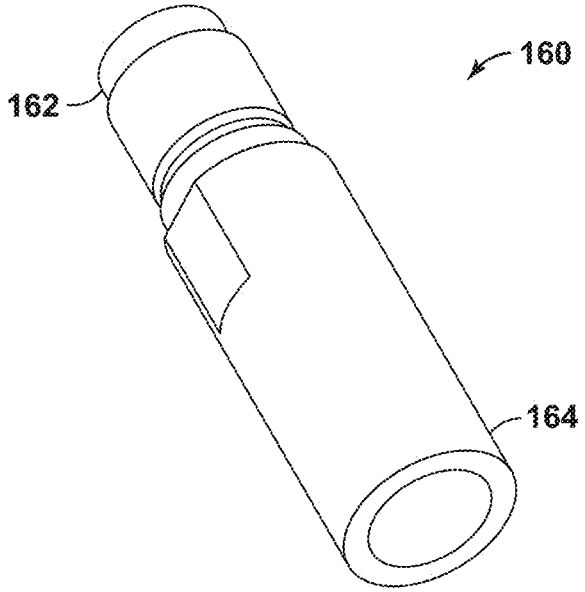
FIG. 9C is a perspective view of the plunger of FIG. 9A.

FIG. 9C is a perspective view of the plunger of FIG. 9A, taken from a distal end. The plunger 160 will be discussed with reference to FIGS. 9A-9C together.

As noted above, the plunger 160 has an upper end 162, a lower end 164 and a bore 165 formed there between. The bore 165 has an inner diameter (ID). The ID is dimensioned to slidingly receive the stem 180 when moving between its back-jetting mode and its flow-through mode. The plunger 160 is made up of a wall 161 that forms the bore 165.

Figure 10A:
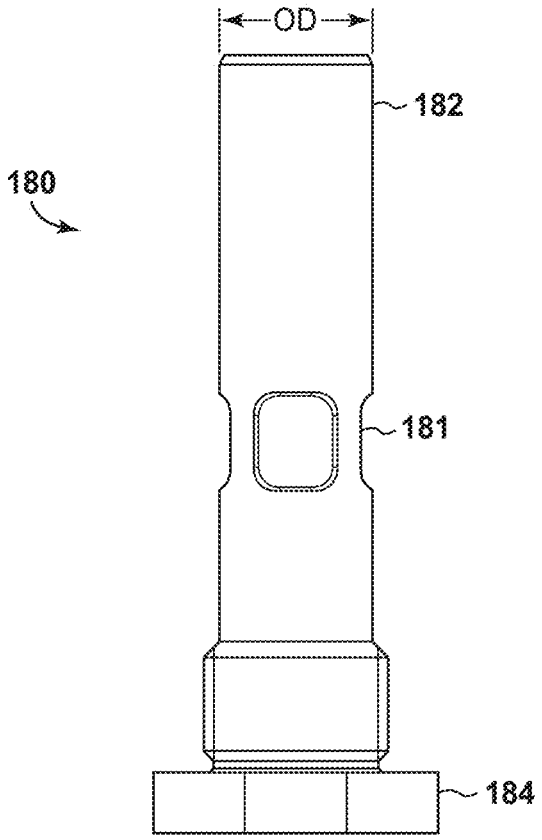
FIG. 10A is a side view of the stem of FIGS. 1A, 1B and 1C.

FIG. 10A is a side view of the stem 180 of FIGS. 1A, 1B and 1C.

Figure 10B:
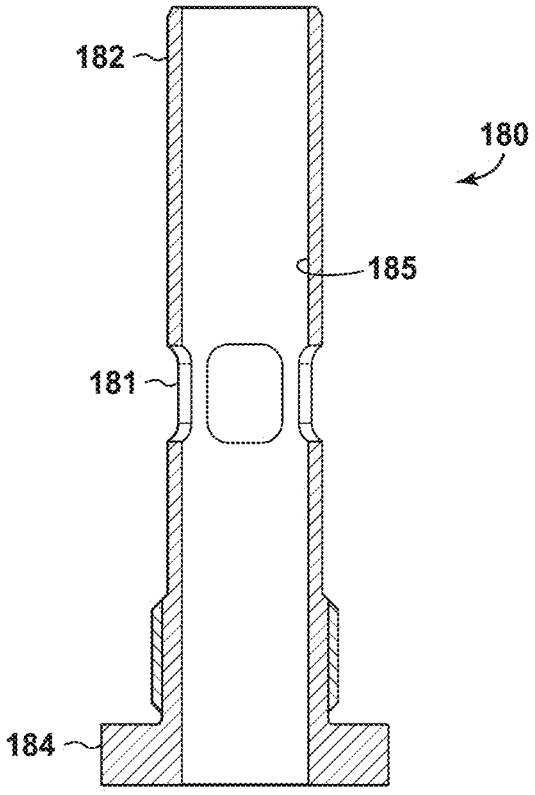
FIG. 10B is cross-sectional view of the stem of FIG. 10A.

FIG. 10B is cross-sectional view of the stem 180 of FIG. 10A.

Figure 10C:
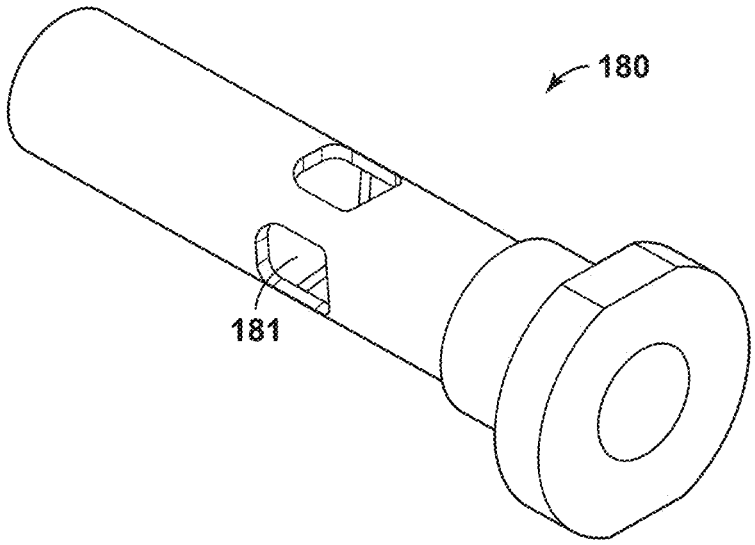
FIG. 10C is a perspective view of the stem of FIG. 10A, taken from the distal end.

FIG. 10C is a perspective view of the stem 180 of FIG. 10A, taken from the distal end. The stem 180 will be discussed with reference to FIGS. 10A, 10B and 10C together.

The stem 180 defines an elongated tubular body. The stem 180 has a proximal (or upper) end 182 and a distal (or downstream) end 184. A bore 185 extends from the proximal end 182 to the distal end 184. Through openings (or "slots") 181 are provided along the stem 180. In the arrangement of FIGS. 10A-10C, four equi-radially disposed slots 181 are provided.

The proximal end 182 of the stem 180 has an outer diameter OD. The OD is dimensioned to be slidably received within the ID of the plunger 160. When the piston assembly 150 and connected plunger 160 are in their raised or intermediate position (or back-jetting mode), the bottom of the plunger 160 resides above the slots 181. In this position, jetting fluids are split, with a portion of fluids flowing through the through-openings 181 and back up to the back jetting ports 148, and a portion flowing on down through the bore 185 of the stem 180.

When the piston assembly 150 and connected plunger 160 are in their lowered (or flow through) mode, the bottom of the plunger 160 advances past the slots 181. In this position, most (and preferably all) of the jetting fluids flow down through the bore 185 of the stem 180 and to a tool below. In either the back-jetting mode or the flow-through mode the plunger 160 is disposed over the OD of the stem 180. In other words, the stem 180 is always overlapping the plunger 160 to at least some extent. In one embodiment, when the piston assembly 150 and connected mandrel 155 are in their upper position, the plunger 160 will overlap with the stem 180 by about ½".

In the arrangement shown in FIGS. 1A-1C and 2A-2C, the stem 180, 280 is received within the plunger 160.

However, the alternate telescopic relationship may also be employed, that is, the plunger 160 is received within the stem 180.

Figure 11A:
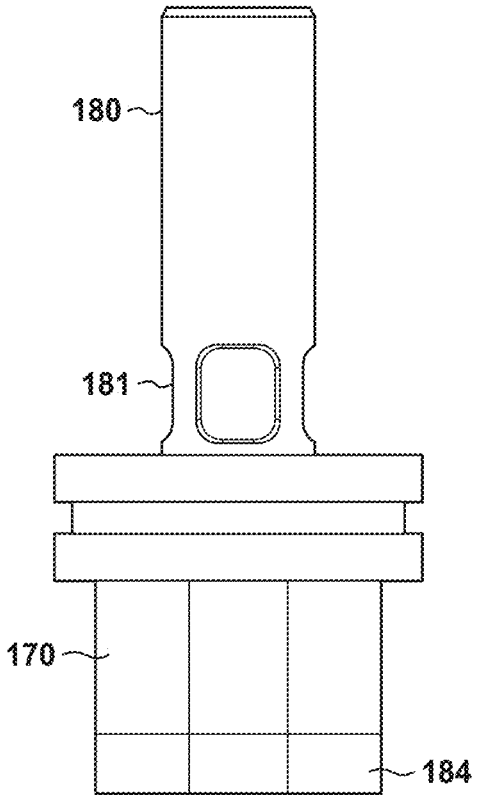
FIG. 11A is a side view of the of the combined stem and seat of FIGS. 1A, 1B and 1C.

FIG. 11A is a side view of the combined seat 170 and stem 180 of FIGS. 1A, 1B and 1C.

Figure 11B:
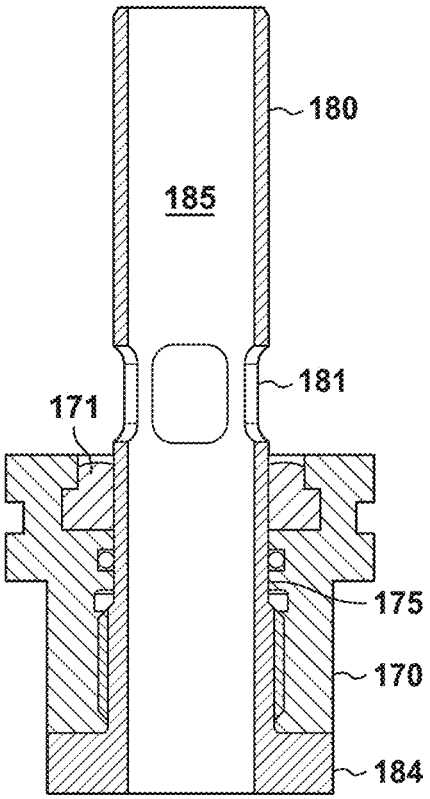
FIG. 11B is a cross-sectional view of the combined stem and seat of FIG. 11A.

FIG. 11B is a cross-sectional view of the combined seat 170 and stem 180 of FIG. 11A.

It can be seen that a shoulder of the seat 170 rests on the proximal end 192 of the bottom sub 190. In this respect, the distal end 184 of the stem 180 flanges out to serve as a base for threadedly connecting the stem 180 and seat 170. An annular seal 171 is placed between an inner diameter of the seat 170 and an outer diameter of the stem 180. The seat 170 and stem 180 are connected to form an integral body, supported by the bottom sub 190.

Figure 12:
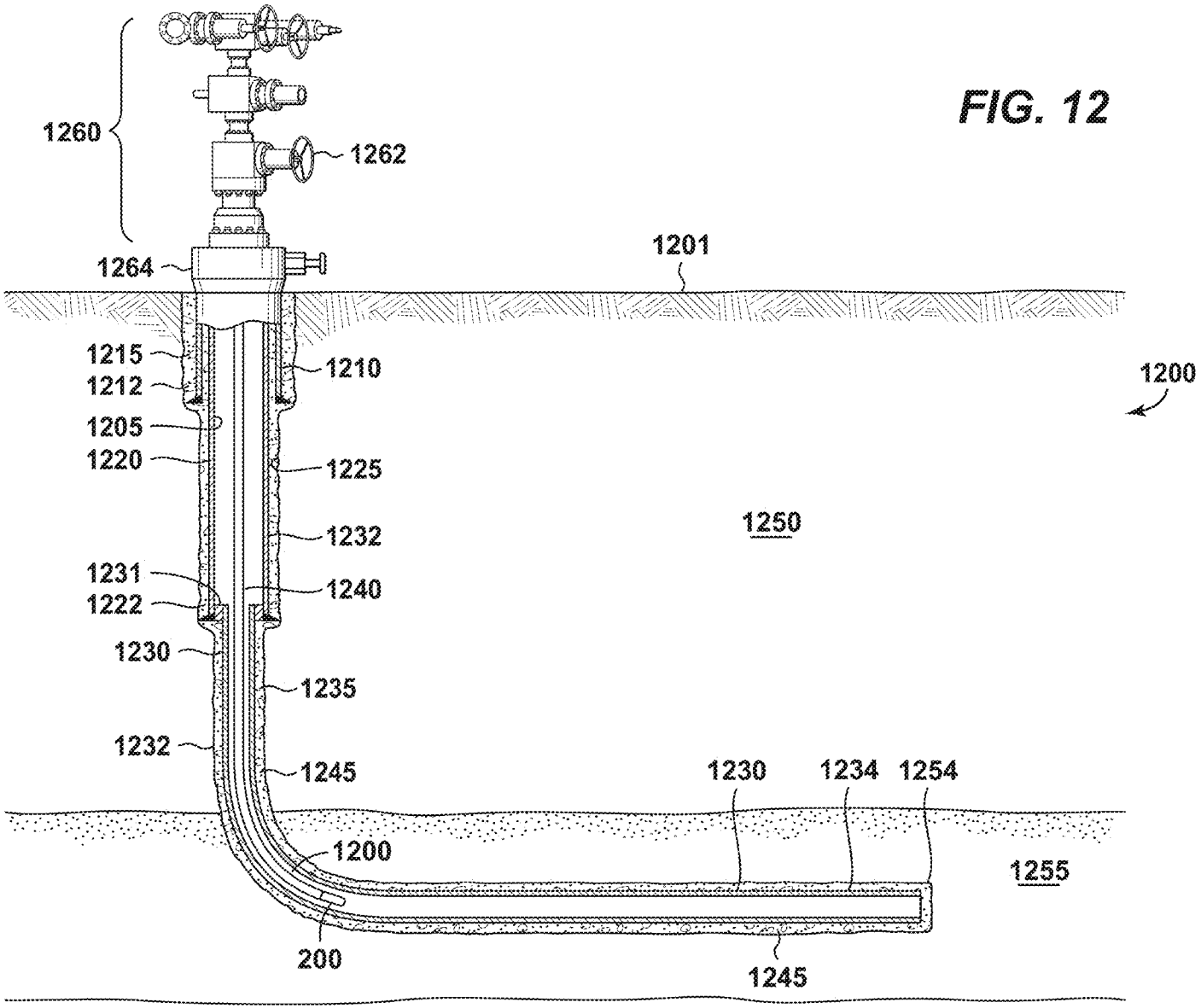
FIG. 12 is a cross-sectional view of a wellbore. Here, the wellbore has received the clean-out tool of FIG. 1A.

As noted above, the clean-out tool 100, 200 (with or without tool 300A or some bottom hole assembly below) is intended to be run into a wellbore. FIG. 12 is a cross-sectional view of an illustrative wellbore 1200. The wellbore 1200 penetrates into a subsurface formation 1250. The wellbore 1200 has been completed as a cased-hole completion for producing hydrocarbon fluids. More importantly for purposes of the present disclosure, the wellbore 1200 has received a multi-cycle clean-out tool such as the tool 200 of FIG. 2A.

It can be seen that the wellbore 1200 has been completed with a series of pipe strings referred to as casing. First, a string of surface casing 1210 has been cemented into the formation 1250. The cement resides in an annular region 1215 around the casing 1210, forming an annular sheath 1212. The surface casing 1210 has an upper end in sealed connection with a bottom wellhead valve 1264.

Next, at least one intermediate string of casing 1220 is cemented into the wellbore 1200. The intermediate string of casing 1220 is in sealed fluid communication with a top wellhead valve 1262. A cement sheath 1222 resides in an annular region 1225 of the wellbore 1200. The combination of the casing 1210/1220 and the cement sheaths 1212, 1222 in the annular regions 1215, 1225 strengthens the wellbore 1200 and facilitates the isolation of aquitards and formations behind the casing 1210/1220. It is understood that a wellbore 1200 may, and typically will, include more than one string of intermediate casing.

Finally, a production string 1230 is provided. The production string 1230 is hung from the intermediate casing string 1220 using a liner hanger 1231. The production string 1230 is a liner that is not tied back to the surface 1201. In the arrangement of FIG. 12, a cement sheath 1232 is provided around the liner 1230. The cement sheath 1232 fills an annular region 1235 between the liner 1230 and the surrounding rock matrix in the subsurface formation 1250.

The production liner 1230 has a lower end 1234 that extends to an end 1254 (or "toe") of the wellbore 1200. For this reason, the wellbore 1200 is said to be completed as a cased-hole well. Those of ordinary skill in the art will understand that for production purposes, the liner 1230 will be perforated after cementing to create fluid communication between a bore 1245 of the liner 1230 and the surrounding rock matrix making up the subsurface formation 1250. In one aspect, the production string 1230 is not a liner but is a casing string that extends back to the surface. In this instance, the cement sheath 1232 will not be extended to the surface 1201.

As an alternative, end 1254 of the wellbore 1200 may include joints of sand screen (not shown). The use of sand screens with gravel packs allows for greater fluid communication between the bore 1245 of the liner 1230 and the surrounding rock matrix 1250 while still providing support for the wellbore 1200. In this instance, the wellbore 1200 would include a slotted base pipe as part of the sand screen joints. Of course, the sand screen joints would not be cemented into place.

It is also noted that the bottom end 1254 of the wellbore 1200 is completed substantially horizontally. This is a common orientation for wells that are completed in so-called "tight" or "unconventional" formations. Indeed, in the United States well over half of all wells are now completed horizontally.

Horizontal completions not only dramatically increase exposure of the wellbore to the producing rock face, but also enable the operator to create fractures that are substantially transverse to the direction of the wellbore. Those of ordinary skill in the art may understand that a rock matrix will generally "part" in a direction that is perpendicular to the direction of least principal stress. For deeper wells, that direction is typically substantially vertical. However, the present inventions have equal utility in vertically completed wells or in multi-lateral deviated wells.

When completed, the wellbore 1200 will include a string of production tubing (not shown). However, before that is done, it is desirable to clean out the wellbore 1200. Accordingly, the wellbore 1200 includes a clean-out tool 200 as shown in FIG. 2A.

It is noted that the clean-out tool 200 is connected to a string of coiled tubing 1240. The coiled tubing string 1240 serves as a working string for delivering an aqueous fluid under high pressures downhole. Such pressures may exceed 500 psi, or even 3,000 psi. The clean-out tool 200 is preferably extended along the horizontal leg of the wellbore along a selected subsurface formation 1255.

A lubricator 1260 or frac tree is placed over the wellbore 1200. The lubricator 1260 is positioned at the surface 1201 to control wellbore pressures during a completion (or other wellbore) operation and to isolate tools such as a string of coiled tubing 1240 being moved into and back out of the wellbore 1200. A water-soluble polymer may be used in the concentration range of about 10 pounds to about 40 pounds per 1,000 gallons of liquid to keep the abrasive particles suspended and to lower friction pressure loss during flow of working fluid through the tubing 1240. A concentration of abrasive particles may be selected depending on wellbore conditions, but normally concentrations up to about one-half pound of abrasive per gallon may be used. Chemicals such as KCl and HCl may be added to the working fluid to assure that the fluid is compatible with the reservoir rock. Preferably, the fluid pumped is filtered to minimize plugging of back jetting ports 148.

In one aspect, the coiled tubing string 1240 is dimensioned to be inserted into a string of production tubing (not shown). In this way, the production tubing may be cleaned out after a period of production.

Using either of the flow diverters 100 or 200 described above, a method 1300 of conducting a wellbore operation is also provided. The method 1300 is presented in the flow chart of FIG. 13.

The method 1300 first includes providing a wellbore. This is indicated at Box 1310. The wellbore is being completed for the production of hydrocarbon fluids. Of interest, the wellbore has been completed with a string of casing, including a string of production casing along a selected subsurface formation.

The wellbore may be completed vertically. Alternatively, the wellbore may be a deviated well formed from a lateral drilling operation. More preferably, the wellbore is completed horizontally as shown in FIG. 12. However, the methods are not limited to the orientation of the wellbore unless expressly stated in the claims.

It is understood that for purposes of Box 1310, the term "providing" includes but is not limited to "forming" or "completing." The term "providing" may also mean that a service company accesses a wellbore that has already been drilled and completed, or accesses a wellbore that has been undergoing production operations for a period of time.

The method 1300 also includes running a clean-out tool into the wellbore. This is provided in Box 1320. The clean-out tool is run into the wellbore at the lower end of a string of coiled tubing 1240. The clean-out tool may be constructed in accordance with any of the embodiments described above. Particularly, the clean-out tool is a multi-cycle tool having a tubular housing that includes an elongated bore. Fluids are pumped from the surface, down the string of coiled tubing, and into the bore.

The clean-out tool includes one or more back jetting ports. At least some of the ports are disposed at an upward angle. In this way, injected clean-out fluids flow through the ports and exit the clean-out tool at an upward angle to sweep any particles or debris in the casing toward the surface (or at least upstream).

The method 1300 additionally includes locating the clean-out tool. This is seen at Box 1330. The clean-out tool is located at a selected depth along a tubular body within the wellbore. Subsurface formation 1255 of FIG. 12 is an example of a location or depth for the clean-out tool. The term "depth" may include "total depth" along a horizontal wellbore.

The method 1300 further includes injecting a clean-out fluid down the coiled tubing string. This is provided at Box 1340. The fluid is a hydraulic fluid that is pumped into the wellbore under pressure. The fluid is pumped down the coiled tubing and into the bore of the tubular housing making up the clean-out tool at a first flow rate. The first flow rate is below an activation rate. The pumping at the first flow rate causes at least a portion of clean-out fluid to flow through the mandrel, through the radial flow-through slots of the stem, back up the lower annular region and through the back jetting ports.

The method 1300 also includes further injecting the clean-out fluid down the coiled tubing and into the bore of the tubular housing at a second flow rate. This is shown at Box 1350. Preferably, though not necessarily, the second flow rate is higher than the first flow rate. In this instance, the higher flow rate increases a hydraulic force acting on a pressure shoulder of a piston, causing a mandrel and connected plunger to slide along a tubular housing such that the plunger is landed on the seat. The result is that all of the injected clean-out fluid flows through a distal end of the tool.

To effectuate the method 1300, it is preferred that a sequencing mechanism be placed along the tubular housing. The sequencing mechanism may be a J-slot mechanism. The J-slot mechanism may be configured to cycle between three settings. Those include:

(i) a first setting wherein a pin associated with the J-slot mechanism resides in a first slot that places the plunger in a raised position in response to a biasing mechanical force exerted by a spring on the mandrel while pumping at a first rate, placing the clean-out tool in a back-jetting mode (shown in FIGS. 1A and 2A);

(ii) a second setting wherein the pin moves higher in the first slot in response to the injection of fluids into the wellbore at a second increased rate, placing the plunger into an intermediate position while allowing the tool to remain in its back-jetting mode (shown in FIGS. 1B and 2B);

(iii) the first setting again wherein the pin resides in a second slot that keeps the plunger in the raised position in response to the upward biasing force of the spring; and (iv) a third setting wherein the pin moves higher along a third slot in response to the injection of fluids into the wellbore at a second increased rate, and wherein the plunger slides from the raised position to the lowered position, placing the clean-out tool in its flow-through mode (shown in FIGS. 1C and 2C).

It is observed that the second increased rate is an activation rate. The pump rate in both the second setting and the third setting may be higher than the activation rate.

Various additional steps may be taken in connection with the method 1300. These relate to tuning the various openings along the tool in order to provide a desired total cross-sectional area of fluid flow. Such steps are presented in Box 1360.

For example, Box 1360 may include a step of adjusting an aperture size of an orifice associated with the piston. This has the effect of varying flow rates associated with the raised and lowered positions. In order for the clean-out tool to change modes, the piston orifice needs to be sized small enough to ensure the required activation rate will be achievable during the operation. Although the clean-out tool will change modes correctly, sizing the piston orifice too small for a planned pump-rate will cause excessive and unnecessary pressure drop that may limit the total flow capacity of the operation in back-jetting mode. Optimally, the piston orifice is sized appropriately to ensure the activation rate will be achievable in both modes throughout the operation with minimal back-pressure.

Additionally, the Box 1360 may also include a step of adjusting a through-opening size of an orifice associated with the seat. Preferably, the orifice is part of a stem placed within the seat. A larger through-opening enables more working fluid to flow through the bore of the clean-out tool and less fluid to back flow to the back jetting ports. Reciprocally, a smaller through-opening allows less fluid to flow through the bore of the clean-out tool and more fluid to back flow to the back jetting ports.

Additionally, the Box 1360 may also include a step of adjusting a size of the back jetting ports. When used with a clean-out tool below the seat, such as a Helix™ nozzle, the back jetting ports should be sized large enough to provide a significantly reduced pressure drop to enable increasing the annular velocity and desirable rate split between the back-jet housing and the Helix while in back-jetting mode. At the same time, the ports should be small enough to provide ample flow restriction for effective jetting.

Additionally, the Box 1360 may include the step of selecting a cross-sectional area for the flow through slots in the stem. The process of selecting total cross-sectional areas through which clean-out fluids may flow is shown in Box 1360.

Figure 13:
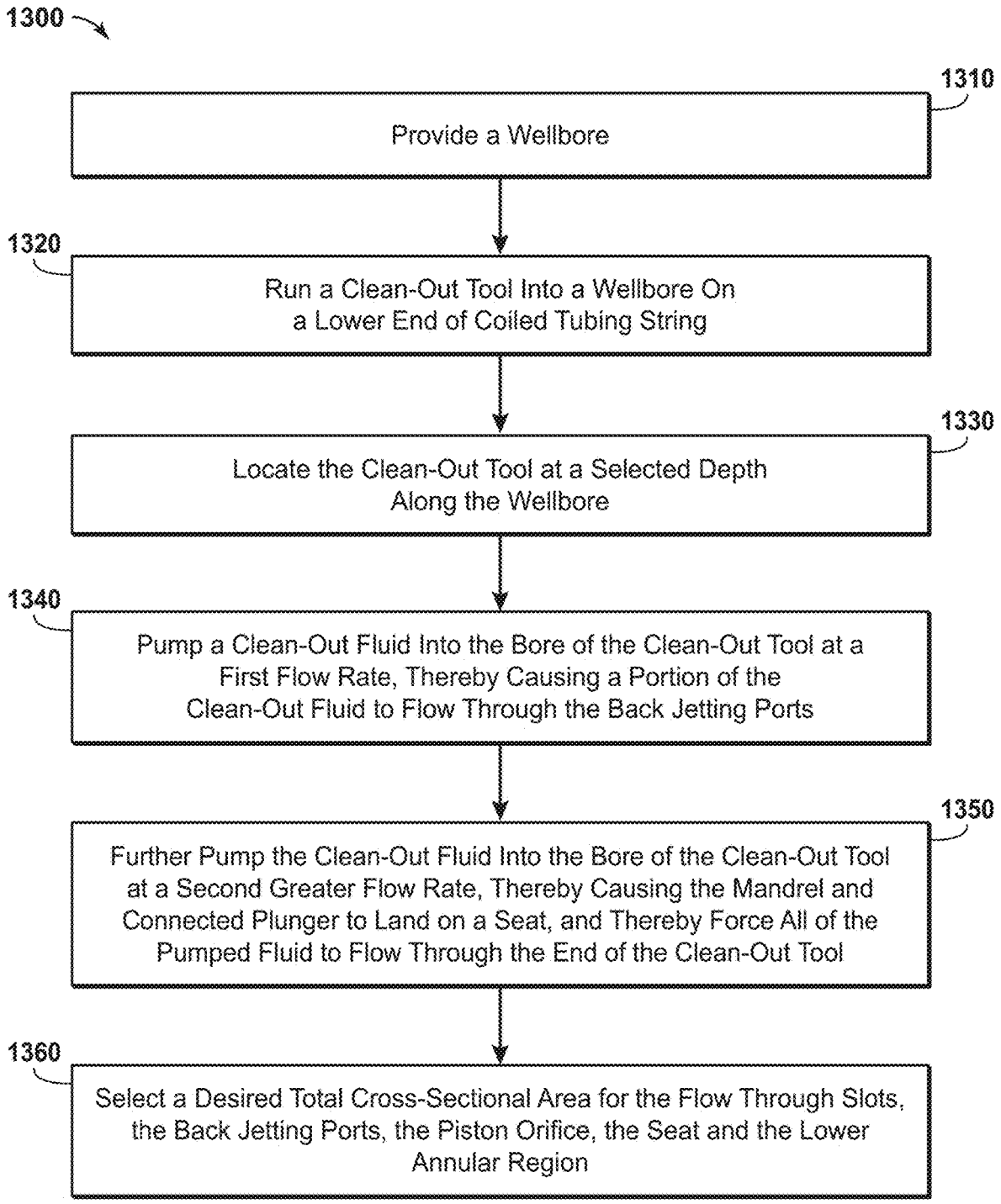
FIG. 13 is a flow chart showing operational steps for controlling a flow of fluid through the clean-out tool, in one arrangement.

It is observed that while Box 1360 is shown at the end of the flow chart for the method 1300 of FIG. 13, it is understood that these steps may and likely will be taken during tool design and before the tool is run into the wellbore in Box 1320.

As can be seen, a unique multi-cycle wellbore clean-out tool has been provided. The clean-out tool acts as a flow diverter that increases the efficiency of fill removal operations. Fluid flow can be entirely in a straight-through path of the tool to an optional bottom hole assembly below while having fluid communication with a back-jetting housing. In this way, flow is split according to a predetermined ratio. The fluid flow can also be entirely cycled back to the straight-through path again. The cycling of fluid flow modes is possible an unlimited number of times and does not require dropping a ball or reversing circulation.

As demonstrated, the modes of the clean-out tool may be manipulated through a combination of flow rate and sequence. Feedback is received at the surface through pump pressure indication. In a first setting, flow rate to the clean-out tool is below an activation rate. This allows the fluid flow to be in communication with the back jet housing as well as a nozzle or any bottom hole assembly or other tool that may be placed below the clean-out tool. In other words, the flow is split between the back jetting ports and a downstream nozzle. This is shown in FIGS. 1A and 2A as well as FIG. 4A.

An activation rate is selected for moving the clean-out tool from its first setting to a second setting. In the second setting, the mandrel and connected plunger begin to slide down the tubular housing towards the seat. The activation rate is based on orifice cross-sectional area selection and may be pre-determined for a specific application.

In the second setting, the plunger will not land on the seat or cover the radial ports of the stem. Instead, downward movement will be restricted by the sequencing mechanism. The use of a sequencing mechanism for cycling allows the operator to pump at a high flow rate (that is, above the activation rate) during back-jetting mode, increasing annular velocity for fill removal in the second setting. Additionally, orientation and selected cross-sectional area of the ports in the back-jetting housing aids in sweeping solids from the casing. This is shown in FIGS. 1B and 2B as well as FIG. 4B.

To advance the sequencing mechanism, the operator will reduce the pump rate back down to or below the first rate. The clean-out tool defaults back to its back-jetting mode.

In a third setting, flow rate is moved back up to, and above, the activation rate. This will advance the sequencing mechanism and allow the plunger to fully land on the seat. This is shown in FIGS. 1C and 2C as well as FIG. 4C. In this position the clean-out tool is in its flow-through mode. In this position, the tool will direct the entire flow through to the nozzle or BHA below. Confirmation of this mode is given through an increase of pump pressure due to the entire flow now exiting through the bottom of the clean-out tool as opposed to the back-jetting ports and the bottom of the clean-out tool simultaneously.

To return to the back-jetting mode, the flow rate may be reduced to a minimum pump-rate until pump pressure has stabilized. The tool will remain in back-jetting mode (FIGS. 1B and 2B) following a subsequent increase in flow rates, even above the activation rate. The tool will continue to remain in this back-jetting mode when the flowrate is lowered down to the minimum pump-rate (FIGS. 1A and 2A).

As can be seen, an improved flow diverter tool 100, 200 for wellbore clean-out operations has been provided. The tool can be used for almost any coiled tubing application wherein fluid is circulated downhole. In a preferred application, the flow diverter tool is used for fill clean-out operations in conjunction with a positive displacement motor, such as motor 300A. Alternatively, a nozzle may be placed below the flow diverter tool. The nozzle may be any type of nozzle such as a so-called wash nozzle, a jetting nozzle, a high pressure rotary nozzle or a pulsating wash tool. The nozzle serves to agitate fill that may have collected in the wellbore, facilitating clean-out in the wellbore while the tool is translated.

It is observed that various nozzles alternative to the Helix™ nozzle mentioned above may be used below the clean-out tool 100, 200. For example, a nozzle for jet drilling such as is disclosed in U.S. Pat. No. 6,668,948 may be used. Alternatively, any of the rotary nozzles as disclosed in U.S. Patent Publ. No. 2016/0160619 may be employed. Alternatively still, the internally rotating nozzle of U.S. Pat. No. 9,845,641 may be used.

As an alternative to a nozzle, the lower sub may be threadedly connected to a bottom hole assembly that includes a sliding sleeve shifting tool. The clean-out tool allows the operator to generate a back jetting flow rate above the activation rate of the sliding sleeve shifting tool for wellbore cleanout while the bottom hole assembly is in the wellbore. This may be done without prematurely activating the sliding sleeve shifting tool. The sliding sleeve shifting tool may be part of an extended reach tool, such as an NOV® agitator tool. Wellbore clean-out can be conducted to a target depth before activating the sliding sleeve shifting tool at its activation rate.

Figure 3E:
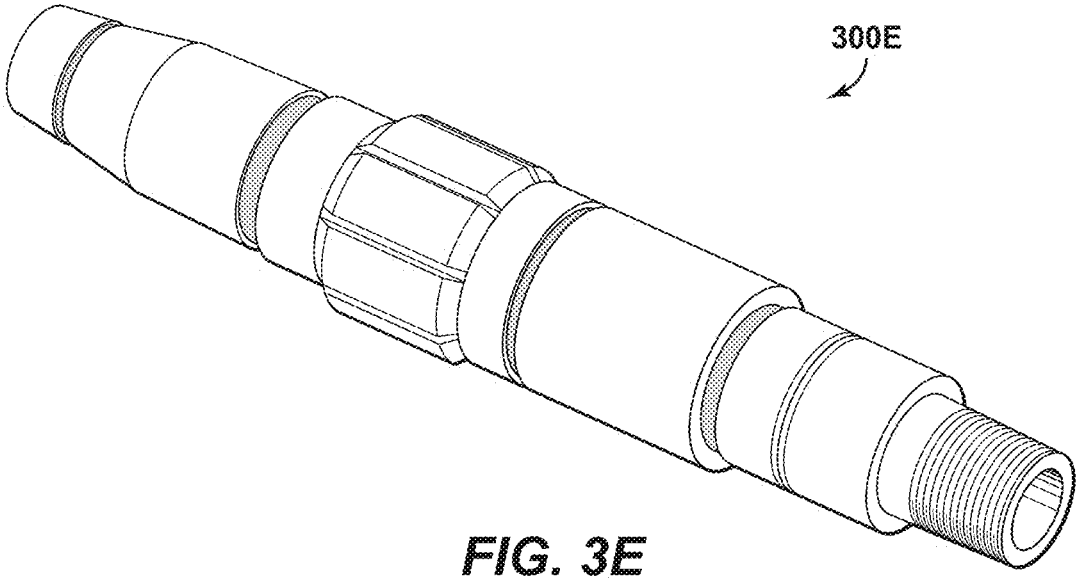
FIG. 3E is an example of a sliding sleeve shifting tool as may be placed below the clean-out tool of either FIG. 1A or FIG. 2A.

FIG. 3E presents an example of a suitable sliding sleeve shifting tool 300E. The sliding sleeve shifting tool 300E may be placed below the clean-out tool of either FIG. 1A or FIG. 2A.

In one application, the flow diverter tool 100, 200 is run into a lateral bore hole. In this instance, a whipstock is placed immediately below the lateral bore hole and the flow diverter tool is then run into the wellbore and against the concave face of the whipstock.

Figure 3F:
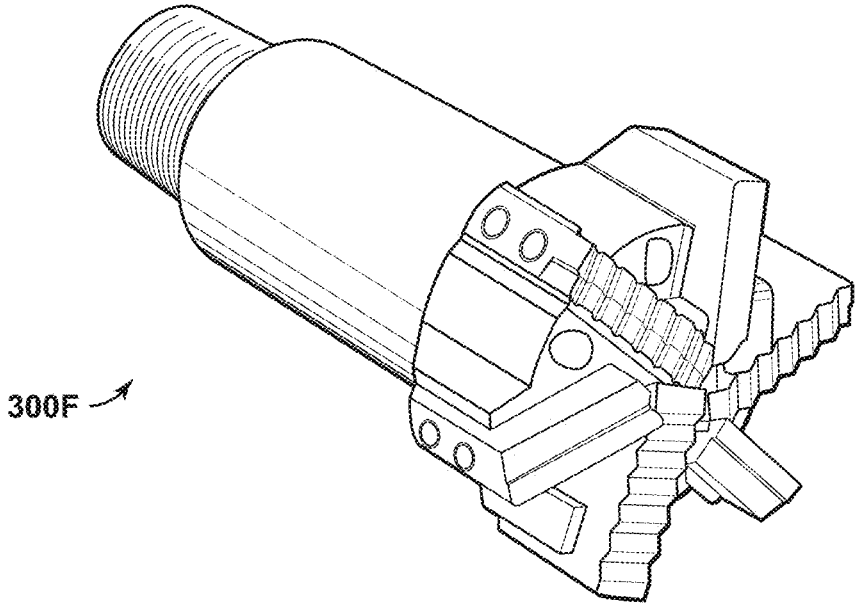
FIG. 3F is a perspective view of an illustrative milling tool that may be placed below the positive displacement motor of FIG. 3A.
Figure 3G:
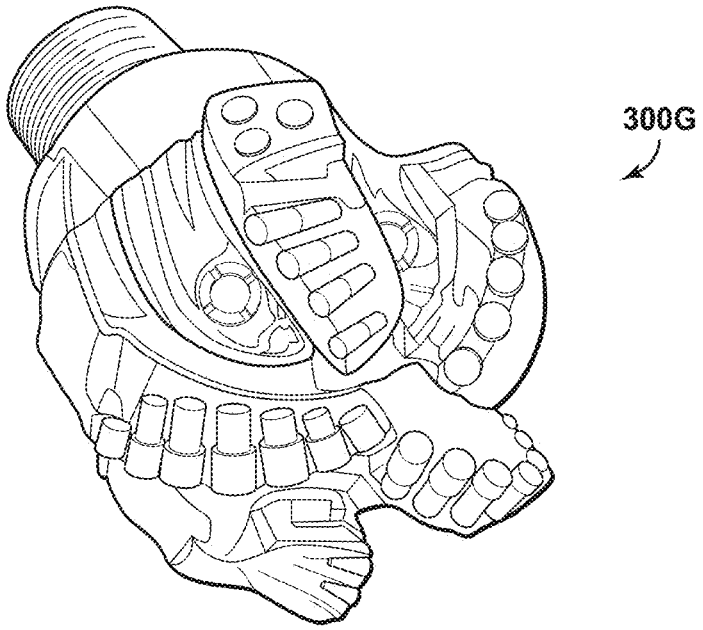
FIG. 3G is a perspective view of an illustrative drill bit that may be placed below the positive displacement motor of FIG. 3A.

The flow diverter tool 100, 200 may also be used in conjunction with milling operations. A milling tool 300F is shown in FIG. 3F. The illustrative milling tool 300F is provided by Schlumberger of Sugar Land, Tex. Generally, milling operations are used to remove scale, cement or consolidated fill in a wellbore. Milling operations may also be conducted to remove plugs that have been placed in the well bore. For milling, the operator may mill a first plug using the fluid flow-through mode, then switch the tool to back to its back-jetting mode to circulate out cuttings at a higher rate. The tool can then be cycled back to the fluid flow-through mode and continue to the next plug for milling again. The tool allows for higher circulation rates without over-running the motor, achieving higher annular velocities.

The flow diverter tool 100, 200 may also be used in connection with drilling operations. A drill bit 300G as may be used for a drilling operation is shown in FIG. 3G. The illustrative drill bit 300G is provided by Schlumberger of Sugar Land, Tex. Specifically, the tool can be placed along a coiled tubing string wherein a well is being deepened, or wherein a side tracking operation is being conducted. In operation, the operator drills out a section of the well with the flow diverter tool in the fluid flow-through mode. The operator then switches the tool to its back-jetting mode and circulates out cuttings at a higher pumping rate. The operator then switches back to the fluid flow-through mode and drills another section of the wellbore. In a drilling operation, the tool again allows for higher circulation rates without over running the motor, achieving higher annular clean-out velocities.

The flow diverter tool 100, 200 may further be used with a back pressure valve during underbalanced situations. In such situations the operator may use a column of nitrogen to lighten the hydrostatic head. After milling a plug and any fill that is encountered, the operator switches back to the back-jetting mode. During this mode, the operator can circulate nitrified fluid down the working string without circulating through the motor. It is noted that with many motors, nitrogen can shorten the life of the stator. Upon circulating the string back to fluid again the operator can switch modes and continue the milling operation.

Of interest, the flow diverter tool 100, 200, 1200 can also be run with setting tools or shifting tools. These include sliding sleeves and multi-stage frac sleeves. An illustrative setting tool 300C is shown in FIG. 3C. This particular setting tool is manufactured by Alpha Oil Tools of Fort Worth, Tex. As noted above, FIG. 3E presents a sliding sleeve shifting tool 300E. The flow diverter tool allows high clean-out circulations rates without activating a completion tool below, e.g., circulating above a shifting tool at a rate above the activation rate of the shifting tool—without the possibility of activating the shifting mechanism in the tool.

In a specific example, the operator may set a resettable bridge plug for a multi-stage fracturing operation with the flow diverter tool 100, 200 installed above the resettable bridge plug. In this instance, circulation remains possible through the back jetting ports without activating a hydraulically activated bridge plug below. In the case of a mechanically set plug, the flow diverter allows the operator to switch between circulating through the bottom of the plug when the plug is not set, and circulating above the plug when the plug is set.

FIG. 3D presents an example of a suitable bridge plug 300D. The bridge plug 300D may be set, retrieved or drilled out using a bottom hole assembly that includes the clean-out tool of FIG. 1A or FIG. 2A.

In another embodiment, the flow diverter tool 100, 200 can be run in connection with an acid stimulation operation. In this instance, a high pressure jetting tool may be run below the flow diverter to remove scale, or clean perforations prior to acidizing. If the rate the formation takes the stimulation fluid is not a limiting factor, the tool can be shifted to divert flow to the larger back jet ports and the rate at which the job is pumped can be increased reducing time and increasing efficiency.

The use of a back pressure valve may also be useful where a sensitive tool is positioned on the tool string below the flow diverter, and the operator wishes to ensure that the sensitive tool will not activate when in back-jetting mode. Basically, any operation where a tool below may restrict the amount of flow that is reasonably possible with the current work string. The tool can increase operational efficiency by either eliminating unneeded trips out of the hole to change tools or reduce operational time by allowing the operator to increase the flow rate and subsequently complete the job faster.

Further, variations of the tool and of methods for cleaning out a wellbore may fall within the spirit of the claims, below. It will be appreciated that the inventions are susceptible to other modifications, variations and changes without departing from the spirit thereof.

We claim:

1. A multi-cycle clean-out tool for controlling a direction of a clean-out fluid within a wellbore, the wellbore having been lined with a string of production casing, and the clean-out tool comprising:

a tubular housing providing an elongated bore through which fluids may be injected, the tubular housing having one or more back jetting ports;

a piston disposed at an upstream end of the housing, the piston forming a pressure shoulder and having at least one orifice configured to deliver clean-out fluid from a wellbore conveyance tubing to the elongated bore of the housing;

a tubular mandrel slidably positioned within the housing, the mandrel having a proximal end connected to or acted upon by the piston, and an open distal end forming a plunger; and a seat disposed along the tubular housing below the distal end of the tubular mandrel, the seat being configured to receive the plunger when the piston and connected tubular mandrel slide from a raised position to a lowered position along the tubular housing, and the seat providing a central orifice for receiving the clean-out fluid;

and wherein the clean-out tool is configured to cycle a position of the mandrel and connected plunger in response to changes in fluid pumping rate into the conveyance tubing, thereby adjusting a relative ratio of flow of clean-out fluid as between the back jetting ports and the seat, but such that all clean-out fluid flows entirely through the mandrel and the seat when the plunger is in the lowered position.

2. The wellbore clean-out tool of claim 1, wherein:

the seat comprises a stem defining an elongated tubular body having an upper end, a lower end, and a bore there between;

the stem extends up from an inner diameter of the seat;

the central orifice of the seat comprises the bore of the stem; and the plunger is configured to move in telescopic relation to the stem in response to the changes in fluid pumping rate.

3. The wellbore clean-out tool of claim 2, wherein:

the bore of the stem provides a restricted opening, forming a pressure indicator.

4. The wellbore clean-out tool of claim 2, wherein the tubular housing comprises:

an upper sub having a first upper end and a second lower end; and a lower sub having a first upper end abutted to the seat, and a lower end threadedly connected to a downhole cleaning tool.

5. The wellbore clean-out tool of claim 4, wherein the downhole cleaning tool is a hydraulic nozzle or a positive displacement motor.

6. The wellbore clean-out tool of claim 2, wherein:

a lower annular region is formed between the mandrel and the surrounding tubular housing providing fluid communication between the elongated bore of the tubular housing and the back jetting ports;

the plunger defines a tubular body having an outer diameter;

the bore of the plunger comprises an inner diameter dimensioned to closely receive the outer diameter of the stem;

the stem comprises at least one slot providing fluid communication between the bore of the plunger and the lower annular region; and at least a portion of the plunger overlaps with the bore of the stem when the piston and connected mandrel are in the raised positioned above the seat.

7. The wellbore clean-out tool of claim 6, wherein:

in the raised position a lower end of the plunger resides above the at least one slot of the stem; and in the lowered position the lower end of the plunger resides below and covers the at least one slot of the stem.

8. The wellbore clean-out tool of claim 7, wherein:

the at least one slot comprises a plurality of radially-disposed slots; and the lower end of the stem comprises a flanged base that is disposed below the seat.

9. The wellbore clean-out tool of claim 7, wherein:

the wellbore further comprises a string of production tubing; and the clean-out tool is dimensioned to be run into or through the string of production tubing.

10. The wellbore clean-out tool of claim 7, further comprising:

a spring residing in an upper annular region between the tubular mandrel and the surrounding tubular housing above the lower annular region, the spring being preloaded in compression to bias the mandrel and connected plunger in a position above the seat; and a sequencing mechanism comprising a cylindrical body, wherein the sequencing mechanism is responsive to a sequence of the fluid pumping rates applied above the piston;

and wherein at least one of the one or more back jetting ports is disposed along the tubular housing at an upward angle.

11. The wellbore clean-out tool of claim 10, wherein the sequencing mechanism is configured to cycle the mandrel between:

its raised position wherein the clean-out tool is in a back-jetting mode;

an intermediate position wherein the clean-out tool remains in its back-jetting mode, and its lowered position wherein the clean-out tool is in a fluid flow-through mode.

12. The wellbore clean-out tool of claim 11, wherein:

the sequencing mechanism is a J-slot sequencing mechanism;

the J-slot sequencing mechanism cooperates with at least one pin disposed along the tubular housing configured to ride in slots along the cylindrical body to cycle the mandrel and connected plunger between the raised position, the intermediate position and the lowered position;

and wherein the pin is fixed from axial movement and rides in J-slots of the mandrel to restrict axial movement of the mandrel on alternating downward strokes.

13. The wellbore clean-out tool of claim 12, wherein the J-slot mechanism and spring are configured to:

(i) maintain the mandrel and connected plunger in its raised position while pumping at or below a first pump rate, placing the clean-out tool in a back-jetting mode wherein a portion of the clean-out fluid flows through mandrel, up the lower annular region, and through the back jetting ports;

(ii) maintain the mandrel and connected plunger in its intermediate position while increasing pump rate above the first pump rate, wherein the clean-out tool remains in its back-jetting mode;

(iii) upon dropping the pump rate back down to or below the first pump rate, maintaining the mandrel and connected plunger in its raised position;

(iv) upon raising the pump rate to a rate that meets or exceeds a second pump rate, move the mandrel and connected plunger to its lowered position, placing the clean-out tool in its flow-through mode wherein all clean-out fluid is forced through the seat and downstream of the clean-out tool; and (v) repeat the cycle of steps (i) through (iv).

14. The wellbore clean-out tool of claim 12, wherein the J-slot mechanism is configured to cycle between three settings, comprising:

(i) a first setting wherein the pin resides in a first slot that places the plunger in the raised position in response to the biasing mechanical force exerted by the spring on the mandrel while pumping at a first rate, placing the clean-out tool in a back-jetting mode;

(ii) a second setting wherein the pin moves higher in the first slot in response to the injection of the clean-out fluid into the conveyance tubing at an increased pump rate, while the plunger remains in intermediate position that keeps the clean-out tool in its back-jetting mode;

(iii) the first setting again wherein the pin resides in a second slot that keeps the plunger in the raised position in response to the biasing mechanical force exerted by the spring; and (iv) a third setting wherein the pin moves higher in a third slot in response to the injection of the clean-out fluid into the conveyance tubing at a second increased rate, or at any rate higher than the second rate, and wherein the plunger slides from the raised position to the lowered position, placing the clean-out tool in its flow-through mode.

15. A method of cleaning out a wellbore using a clean-out tool, the wellbore having been lined with a string of production casing along a selected subsurface formation, and the method comprising:

running a clean-out tool into the wellbore on a lower end of a string of coiled tubing, the clean-out tool comprising:

a tubular housing providing an elongated bore through which fluids are injected, the tubular housing having one or more back jetting ports;

a piston disposed at an upstream end of the housing, the piston forming a pressure shoulder and having at least one orifice configured to deliver clean-out fluid from the coiled tubing string to the elongated bore of the housing;

a tubular mandrel slidably positioned within the housing, the mandrel having a proximal end connected to or acted upon by the piston, and an open distal end forming a plunger; and a seat disposed along the tubular housing below the distal end of the tubular mandrel, the seat being dimensioned to receive the plunger when the piston and connected tubular mandrel slide from a raised position to a lowered position along the tubular housing, and the seat providing a central orifice for receiving the clean-out fluid;

locating the clean-out tool at a selected depth along the wellbore;

injecting clean-out fluid down the coiled tubing and into the bore of the tubular housing at a first flow rate, thereby causing at least a portion of the clean-out fluid to flow through the mandrel, up a lower annular region and through the back jetting ports while a remaining portion flows through a distal end of the tubular housing;

further injecting the clean-out fluid down the coiled tubing and into the bore of the tubular housing at a second flow rate that is higher than the first flow rate, thereby increasing a hydraulic force acting on the pressure shoulder of the piston and causing the mandrel and connected plunger to slide along the tubular housing such that the plunger advances to the seat, thereby forcing all of the injected clean-out fluid to flow through the distal end of the tubular housing.

16. The method of claim 15, wherein:

the seat comprises a stem defining an elongated tubular body having an upper end, a lower end, and a bore there between;

the stem extends through an inner diameter of the seat; and the central orifice of the seat is the bore of the stem.

17. The method of claim 16, wherein:

the bore of the stem provides a restricted opening, forming a pressure indicator.

18. The method of claim 16, wherein the tubular housing comprises:

an upper sub having a first upper end and a second lower end; and a lower sub having a first upper end connected to the seat, and a lower end threadedly connected to a downhole cleaning tool.

19. The method of claim 18, wherein the downhole cleaning tool is a nozzle or a positive displacement motor.

20. The method of claim 16, wherein the clean-out tool further comprises:

a lower annular region formed between the mandrel and the surrounding tubular housing providing fluid communication between the elongated bore of the tubular housing and the back jetting ports;

the plunger defines a tubular body having an outer diameter;

the plunger overlaps the stem when the plunger is in its raised position;

the stem comprises at least one slot providing fluid communication between the bore and the lower annular region; and the plunger and the stem reside in telescopic relation to one another.

21. The method of claim 20, wherein:

in the raised position a lower end of the plunger resides above the at least one slot of the stem; and in the lowered position the lower end of the plunger resides below the at least one slot of the stem.

22. The method of claim 21, wherein:

the at least one slot comprises a plurality of radially-disposed slots; and the lower end of the plunger comprises a flanged base that is disposed below the seat.

23. The method of claim 21, wherein the clean-out tool further comprises:

a spring residing in an upper annular region between the tubular mandrel and the tubular housing above the lower annular region, the spring being pre-loaded in compression to bias the mandrel and connected plunger in the first raised position; and a sequencing mechanism comprising a cylindrical body, wherein the sequencing mechanism is responsive to a sequence of flow rates applied above the piston;

and wherein at least one of the one or more back jetting ports is disposed along the tubular housing at an upward angle.

24. The method of claim 23, wherein the sequencing mechanism is configured to cycle the mandrel between:

a raised position wherein the clean-out tool is in a back-jetting mode;

an intermediate position wherein the clean-out tool remains in its back-jetting mode and the ports are not covered by the plunger even though flow rate is above an activation rate, and a lowered position wherein the clean-out tool is in a fluid flow-through mode.

25. The wellbore clean-out tool of claim 24, wherein:

the sequencing mechanism is a J-slot sequencing mechanism;

the J-slot sequencing mechanism cooperates with at least one pin disposed along the tubular housing configured to ride in slots along the cylindrical body to cycle the mandrel and connected plunger between the raised position, the intermediate position and the lowered position;

and wherein the pin is fixed from axial movement and rides in the J-slots of the mandrel to restrict axial movement of the mandrel on alternating downward strokes.

26. The method of claim 25, wherein the J-slot mechanism and spring are configured to:

(i) maintain the clean-out tool in its raised position while pumping at or below a first pump rate, placing the clean-out tool in a back-jetting mode wherein a portion of the clean-out fluid flows through the mandrel, up the lower annular region, and through the back jetting ports;

(ii) maintain the clean-out tool in its intermediate position while increasing pump rate above the first pump rate, and wherein the same portion of the clean-out fluid flows through the mandrel, up the lower annular region and through the back jetting ports;

(iii) upon dropping the pump rate back down to or below the first pump rate, maintaining the clean-out tool in its raised position;

(iv) upon raising the pump rate to a rate that meets or exceeds a second pump rate, move the clean-out tool to its lowered position, placing the clean-out tool in its flow-through mode wherein all clean-out fluid is forced through the seat and downstream of the clean-out tool; and (v) repeat the cycle of steps (i) through (iv).

27. The method of claim 26, wherein step (v) is done without reverse circulating in the wellbore.

28. The method of claim 26, wherein the J-slot mechanism and spring are configured to cycle between three settings, comprising:

(i) a first setting wherein the pin resides in a first slot that places the plunger in the raised position in response to the biasing mechanical force exerted by the spring on the mandrel while pumping at a first rate, placing the clean-out tool in a back-jetting mode;

(ii) a second setting wherein the pin moves higher in the first slot in response to the pumping of the clean-out fluid into the coiled tubing at an increased pumping rate, so that the plunger advances to the intermediate position while remaining in its back-jetting mode;

(iii) the first setting again wherein the pin resides in a second slot that allows the plunger to remain in the raised position; and (iv) a third setting wherein the pin moves higher in the second slot in response to the injection of the clean-out fluid into the coiled tubing at a second increased rate, or at any rate higher than the second rate, and wherein the plunger slides from the raised position to the lowered position, placing the clean-out tool in its flow-through mode.

29. The method of claim 28, further comprising:

adjusting an aperture size of the orifice associated with the piston, thereby accommodating flow rate variations associated with the raised and lowered positions arising from changes in mandrel dimensions.

30. The method of claim 24, further comprising:

selecting a cross-sectional area of the piston orifice, selecting a cross-sectional area of the one or more back jetting ports;

selecting a cross-sectional area of the flow-through slots in the stem;

selecting a cross-sectional area of the lower annular region;

selecting a cross-sectional area of the seat; or combinations thereof, before running the clean-out tool into the wellbore.

31. The method of claim 24, further comprising:

selecting a cross-sectional area of the flow-through slots in the stem, thereby adjusting a ratio of clean-out fluids that pass through the flow-through slots and the seat during the back-jetting mode.

32. The method of claim 24, further comprising:

monitoring a pressure of the clean-out fluid from the surface as it is injected into the tubular housing; and receiving confirmation that the clean-out tool has entered its flow-through mode when pressure reaches a designated level.

33. The method of claim 16, wherein:

the wellbore comprises a string of production tubing, and running a clean-out tool into the wellbore comprises running the coiled tubing string and connected clean-out tool into the string of production tubing.

34. A method of cleaning out a wellbore using a clean-out tool, comprising:

(a) placing a clean-out tool in the wellbore along a string of production casing, the clean-out tool comprising:

a tubular housing providing an elongated bore through which fluids may flow, the tubular housing having one or more back jetting ports disposed at an upward angle therein;

a piston disposed at an upstream end of the housing, the piston forming a pressure shoulder and having at least one orifice configured to deliver fluids from a conveyance string to the elongated bore of the housing;

a tubular mandrel slidably positioned within the housing, the mandrel having a proximal end connected to or acted upon by the piston, and an open distal end forming a plunger;

a seat disposed along the tubular housing below the distal end of the tubular mandrel, the seat being dimensioned to receive the plunger when the piston and connected mandrel slide from a raised position to a lowered position within the tubular housing, and the seat providing a central orifice for receiving a clean-out fluid; and a lower sub having a first upper end proximate to the seat, and a lower end threadedly connected to a downhole cleaning tool;

(b) locating the clean-out tool and connected downhole cleaning tool within the wellbore;

(c) pumping the clean-out fluid down the wellbore and into the clean-out tool at or above an activation rate, causing the tubular mandrel and connected plunger to move to its lowered position on the seat (providing a flow-through mode) while operating the downhole cleaning tool;

(d) continuing to pump the clean-out fluid down the wellbore and into the clean-out tool at a rate above the activation rate in order to initiate operation of the downhole cleaning tool; and (e) pumping the clean-out fluid down the wellbore and into the clean-out tool at a rate below the activation rate, causing the tubular mandrel and connected plunger to move to the raised position above the seat providing a "back jetting mode" so that at least a portion of the clean-out fluid flows through the back jetting ports, while also discontinuing operation of the downhole cleaning tool.

35. The method of claim 34, wherein the clean-out tool further comprises:

a lower annular region formed between the mandrel and the surrounding tubular housing providing fluid communication between the elongated bore of the tubular housing and the back jetting ports;

a J-slot mechanism responsive to the fluid flow rates and configured to cycle between the back-jetting mode and the flow-through mode.

36. The method of claim 35, wherein:

the plunger defines a tubular body having an outer diameter;

the seat comprises a stem that extends up from the central orifice of the seat;

the plunger telescopically moves relative to the stem;

the stem comprises at least one slot providing fluid communication between the bore and the lower annular region; and at least a portion of the plunger slidably overlaps with the stem when the piston and connected mandrel are in the raised position above the seat.

37. The method of claim 36, wherein:

in the raised position a lower end of the plunger resides above the at least one slot of the stem; and in the lowered position the lower end of the plunger resides below the at least one slot of the stem.

38. The method of claim 37, wherein the at least one slot comprises a plurality of radially-disposed slots.

39. The method of claim 35, wherein:

the downhole cleaning tool is a milling tool; and operating the downhole cleaning tool comprises milling a plug within the wellbore.

40. The method of claim 39, further comprising:

lightening a hydrostatic head formed by the clean-out fluid during the back-jetting mode.

41. The method of claim 35, wherein:

the downhole cleaning tool is a drilling tool; and operating the downhole cleaning tool comprises drilling a formation to extend the wellbore.

42. The method of claim 35, wherein:

a setting tool resides within the wellbore downstream from the downhole cleaning tool; and the method comprises cleaning out the wellbore while the clean-out tool is in its back-jetting mode without activating the setting tool.

43. The method of claim 35, wherein:

a resettable bridge plug resides within the wellbore downstream from the downhole cleaning tool; and the method comprises:

cleaning out the wellbore while the clean-out tool is in its back-jetting mode and while the resettable bridge plug is not set; and cleaning out the wellbore while the clean-out tool is in its flow-through mode while the resettable bridge plug is set.

44. The method of claim 35, wherein:

the downhole cleaning tool is a hydraulic nozzle; and operating the downhole cleaning tool comprises injecting acid into the clean-out tool as the clean-out fluid.

45. The method of claim 35, wherein:

the downhole cleaning tool is a sliding sleeve shifting tool; and operating the downhole cleaning tool comprises:

cleaning out the wellbore while the clean-out tool is in its back-jetting mode and without activating the sliding sleeve shifting tool;

placing the clean-out tool in its flow-through mode; and shifting a sliding sleeve associated with the sliding sleeve shifting tool in the wellbore while the clean-out tool is in its flow-through mode.

* * * * *